United States Patent [19]

Yamada

[11] Patent Number: 5,049,933

[45] Date of Patent: Sep. 17, 1991

[54] IMAGE EDIT INPUT DEVICE FOR USE IN COPYING MACHINE

[75] Inventor: Hirokazu Yamada, Osaka, Japan

[73] Assignee: Minolta Camera Kabushiki Kaisha, Osaka, Japan

[21] Appl. No.: 468,933

[22] Filed: Jan. 23, 1990

[30] Foreign Application Priority Data

Jan. 27, 1989 [JP] Japan ..... 1-18946
Jan. 27, 1989 [JP] Japan ..... 1-18947
Jan. 27, 1989 [JP] Japan ..... 1-18948
Jan. 27, 1989 [JP] Japan ..... 1-18949

[51] Int. Cl.[5] ..... G03G 15/00
[52] U.S. Cl. ..... 355/218; 340/712
[58] Field of Search ..... 355/200, 202, 209, 218; 340/712

[56] References Cited

U.S. PATENT DOCUMENTS 3,914,043 10/1975 McVeigh ..... 355/326
4,742,373 5/1988 Nakatani et al. ..... 355/202
4,764,789 8/1988 Iwaki et al. ..... 355/209
4,806,978 2/1989 Nakatani et al. ..... 355/202
4,870,458 9/1989 Shibuya et al. ..... 355/218 X

*Primary Examiner*—Joan H. Pendegrass
*Attorney, Agent, or Firm*—Joseph W. Price

[57] ABSTRACT

An image edit input device is disclosed which feeds data concerning an edit area of an original document to a copying machine. This image edit input device is provided with a tablet possessed of a surface conforming in size with an original document. On this tablet are inscribed marks for effecting the input of special data such as ratio of copying magnification, number of copies to be produced, and size of copying paper. By the depression of the tablet, therefore, special modes and copy data such as the number of copies to be produced can be injected as an input other than the coordinates data of the edit area can be fed in. When the tablet is depressed, the question as to whether this depression is for feeding the coordinates data or the data other than the coordinates data is decided by the manipulation of switches.

8 Claims, 27 Drawing Sheets

IMAGE EDIT INPUT DEVICE FOR USE IN COPYING MACHINE

BACKGROUND OF THE INVENTION

1. Field of the Invention:

This invention relates to a original document image edit input device for use in a copying machine, which device is adapted to feed edit coordinates data and copy mode data into the copying machine serving to reproduce an image of an original document on a copying paper.

2. Description of related arts:

Among the copying machines are counted those of the type possessing an edit copying function of enabling only a specific image, selected from the image of an original document being reproduced on a copying paper by the use of a copying machine, to be actually reproduced on the copying paper. This edit copying embraces such actions as trimming for erasing the area of an original document other than the area of a specific image and masking for preventing a specific area from being reproduced on a copying paper. In the execution of this edit copying mode, there are times when an image edit device is used for facilitating the operators work in designating a specific area in a given original document.

In U.S. Pat. No. 4,742,373, an edit device provided with a tablet for editing an original document is disclosed as adapted to be mounted on a document table of a copying machine. When the edit device is in the mode for feeding in coordinates values, a coordinates signal is issued by a push given to a relevant point on the surface of the tablet. This copying machine in the character input mode produces a character read signal and, based on this signal, causes a relevant character pattern stored in the memory to be reproduced on a copying paper.

U.S. Pat. No. 4,764,789 discloses a copying machine so configured that input data are stored in an IC card and edit data are transferred from this IC card to the copying machine by the operation of a tablet. U.S. Pat. No. 4,806,978 discloses a memory card which memorizes data concerning copying introduced through a tablet and transfers the data to a copying machine.

Many of the edit devices heretofore known are provided with a tablet for designating an edit area in a original document and an operation panel for inputting data on size of copying papers required for the ordinary copying operation other than that of the edit mode and data on the number of copying papers. The key switches which are disposed on the operation panel for the edit device and adapted to input copying data are generally equal in function and in number to key switches disposed on the operation panel provided for the copying machine. The operation other than the designation of an edit area, i.e. the input of data, therefore, is accomplished by depressing the key switch on the operation panel for the copying machine or by depressing the key switch on the operation panel for the edit device. If the copying machine is adapted so as to operate in a large number of copying modes, the operation panel for the edit device is required to be provided with a proportionately large number of key switches and, therefore, is required to become voluminous.

SUMMARY OF THE INVENTION

An object of this invention is to provide an image edit input device provided with a tablet capable of not merely designating an edit area in a original document but also inputting special data such as the number of copying papers.

Another object of this invention is to provide an image edit input device comprising a tablet for designating an edit area in an original document and an operation panel for inputting various modes and data into a copying machine and adapted to allow input of numerous modes and data for copying through the operation panel despite the smallness of size of the operation panel.

Still another object of this invention is to provide an edit input device furnished with a tablet having key marks indicative of sizes of copying papers printed thereon and adapted to permit input as an input of a desired copying paper size by a push given to the tablet at the portion of a relevant key mark.

Yet another object of this invention is to provide an edit input device furnished with a tablet having ten-key marks printed thereon and adapted to permit input as an input of either a number of copying papers or a magnification of copying by a push given to the tablet at the portion of a relevant mark.

A further object of this invention is to provide an edit input device furnished with a changeover switch for drawing a distinction as to whether a push given to a tablet at a desired point is meant to designate an edit area or to effect input as an input of operating data printed on the tablet.

In accordance with the present invention, there is provided an original document image edit input device for supplying data on copying mode and editing mode to a copying machine serving to reproduce an image of an original document on a copying paper, which device comprises; a tablet provided with a surface conforming to an original document to be copied; coordinate data forming means adapted to produce, in response to a depression on the surface of said tablet in the ordinary input mode, coordinates data corresponding to the coordinate of the position of said depression; switching means for switching the input mode from said ordinary input mode to the numerical input mode; and numerical data forming means for forming, in response to a depression exerted at a desired position on the surface of said tablet in the situation in which said numerical value input mode has been set by said switching means, numerical data corresponding to the position of said depression and differing from said coordinates data.

In this invention, when the operator manipulates the portion of a size mark printed on the tablet while an original document is mounted on the tablet, the size data of a copying paper corresponding in size to the original document and the data indicative of the direction of advance, longitudinal or lateral, of the copying paper are injected as an input. The operator, therefore, is enabled to effect ready inputted as an input of the size data of the copying paper even when he is unaware of the size of the original document and indifferent to the relation between the direction of the original document mounted on the tablet and the direction of the copying paper set in place inside the copying machine.

Further in the present invention, since the numerical data used inputting as an input the number of copying papers and the magnification of copying can be so fed in by manipulating the portion of numerals printed on the tablet, the operation panel of the edit input device is not required to be provided with the corresponding numerical keys.

DESCRIPTION OF THE PREFERRED EMBODIMENTS

This invention will be described in detail below with reference to preferred embodiments illustrated in the accompanying drawings.

Figure 1:
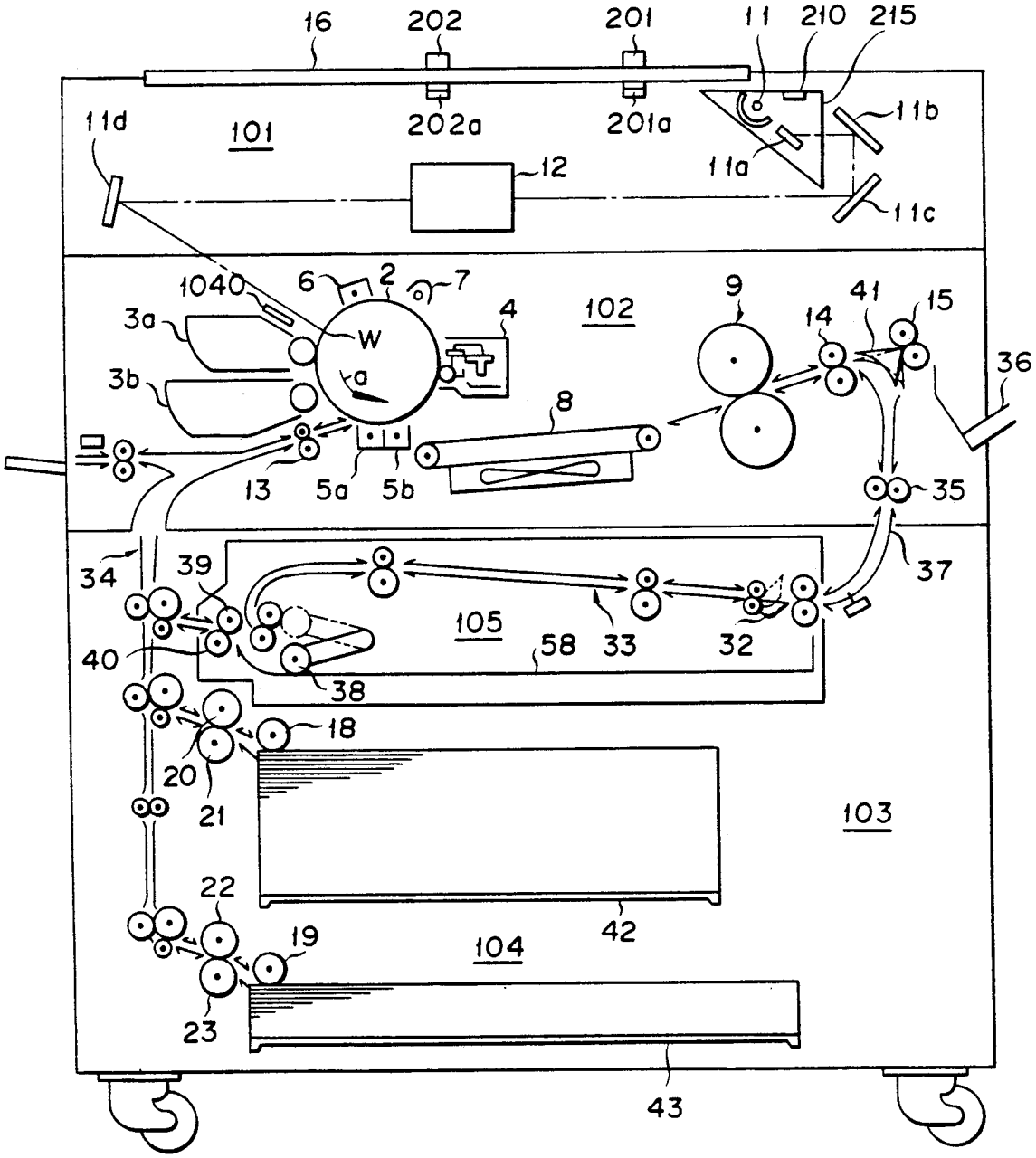
FIG. 1 is a schematic diagram illustrating the inner structure of a copying machine whose operation is controlled by an edit input device of the present invention.

FIG. 1 is a schematic cross section illustrating the structure of a copying machine embodying this invention.

As illustrated in FIG. 1, the copying machine comprises an optical system 101 for optically scanning an original document on a document table 16, an image forming system 102 for reproducing an image of the aforementioned original document by the electrophotographic process, and a sheet conveying system 103 for conveying a copying paper. The sheet conveying system 103 comprises a paper feeding unit 104 and a paper refeeding unit 105.

(a) Optical system

Figure 10:
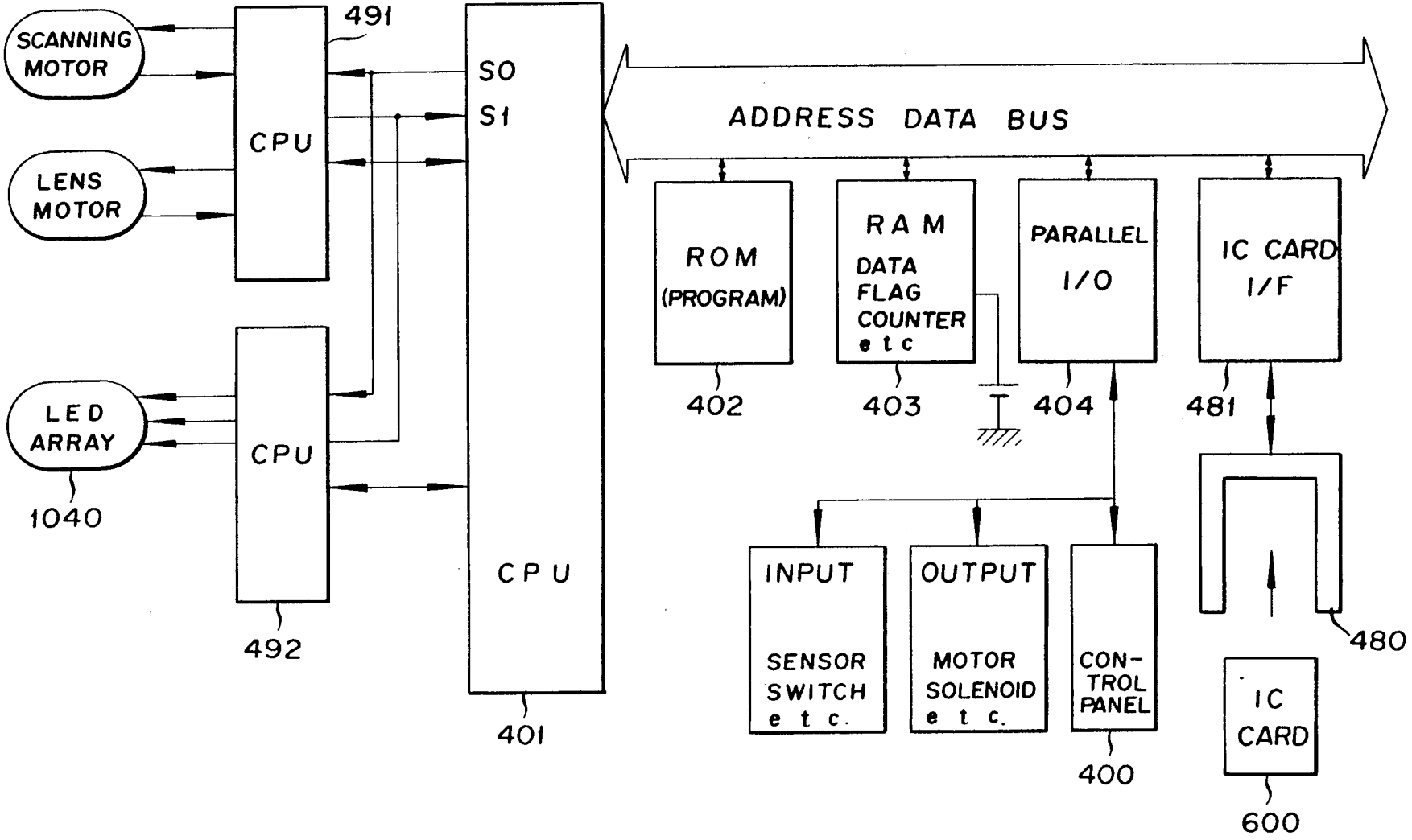
FIG. 10 is a block diagram illustrating a control circuit of the copying machine.

The optical system 101 comprises a light source 11, movable mirrors 11*a*, 11*b*, and 11*c*, a stationary mirror 11*d*, and a lens 12. The light source 11 and the movable mirror 11*a* are attached fast to a moving member 215. This moving member 215 is reciprocated along the underside of the document table 16 for the purpose of producing an optical scanning motion. During the optical scanning motion, the moving member 215 is moved at a speed of V/N, wherein V stands for the peripheral speed of a photosensitive drum and N for the magnifying ratio of copying. The movable mirrors 11*b* and 11*c* are attached fast to another moving member (not shown) and are moved at a speed of V/2N. Their movement is effected with a scanning motor (FIG. 10). The position of the lens 12 and the position and the angle of inclination of the stationary mirror 11*d* are controlled by a lens motor (FIG. 10) proportionately to the magnifying ratio of copying.

(b) Image forming system

The image forming system 102 is provided with a photosensitive drum 2 adapted to rotate in the direction indicated by the arrow a. Around the photosensitive drum 2 are disposed an eraser lamp 7 serving to remove electric charge remaining on the surface of the photosensitive drum 2, a corona charger 6 serving to effect uniform electric charging of the surface of the photosensitive drum, an LED array 1040 for removing electric charge in an area not destined to participate in the formation of an image, and a first and a second developing device 3*a*, 3*b* for applying a toner to an electrostatic latent image formed on the surface of the photosensitive drum 2. The first developing device 3*a* contains the toner of a color other than black such as, for example, red and the second developing device 3*b* the toner of black. Further around the periphery of the photosensitive drum 2 are disposed a transfer charger 5*a* for transferring onto a copying paper a toner image formed on the surface of the photosensitive drum 2, a separation charger 5*b* for peeling the transfer paper from the surface of the photosensitive drum 2, and a cleaning device 4 for removing from the peripheral surface of the photosensitive drum 2 the toner remaining thereon after the toner image has been transferred onto the copying paper.

A copying paper fed out of the sheet conveying system 103 is conveyed to a timing roller 13 and forwarded thence at a prescribed timing to a gap intervening between the photosensitive drum 2 and the transfer charger 5*a* to have a toner image transferred thereon. The copying paper thus undergone the toner image transfer is conveyed by a conveyor belt 8 to a fixing device 9, there to have the toner image thermally fused thereto. The copying paper, after passing through a roller pair 14, is either discharged by a roller pair 15 into a discharged paper tray 36 or returned by a roller pair 35 to the sheet conveying system 103. To permit the switch between discharging the copying paper into the tray 36 and returning it to the sheet conveying system 103, a changeover switch 41 operated with a solenoid (not shown) is interposed between the roller pair 14 and 15.

(c) Sheet conveying system

Inside the sheet conveying system 103 is disposed the paper feeding unit 104 which comprises an upper feed paper tray 42 and a lower feed paper tray 43 for holding copying papers of different sizes. The copying papers in the feed paper tray 42 are drawn out one by one by a feed paper roller 18 and forwarded by a pair of rollers 20, 21 to the aforementioned timing roller 13 via a feed paper passage 34. Similarly, the copying papers in the feed paper tray 43 are drawn out one by one by a feed paper roller 19 and then forwarded by a pair of rollers 22, 23 to the timing roller 13 via the feed paper passage 34. In the image forming system 102, the copying paper originating in either of the feed paper trays has the image of an original document reproduced thereon.

This copying machine is set in either the composite copy mode or the double-faced copy mode. The term "composite copy" refers to reproduction of a composited image on one surface of a copying paper by two continuous consecutive executions of the image-forming process and the term "double-faced copy" refers to reproduction of images one each on the obverse and reverse surfaces of a copying paper by two consecutive executions of the image-forming process. When the copying machine is set in either of the composite copy mode and the double-faced copy mode, the changeover switch 41 is moved to the position indicated by a continuous line and the copying paper which has undergone the first copying operation is transferred through a passage 37 to the interior of the paper refeeding unit 105 installed in the sheet conveying system 103.

When the copying machine is set in the composite copy mode, the copying paper which has undergone the first copying operation is passed through the passage 37 and immediately stored temporarily in a tray 58 disposed in the paper refeeding unit 105. In this case, a changeover lever 32 disposed in the inlet part of the paper refeeding unit 105 is set at the position indicated by an imaginary line. In contrast, when the copying machine is set in the double-faced copy mode, the changeover lever 32 is turned to the position indicated by a continuous line and the copying paper which has undergone the first copying operation is passed through the passages 37 and 33 and stored temporarily in the tray 58 mentioned above. The surface of the copying paper on which an image has been already formed falls on the lower side in the case of the composite copy or on the upper side in the case of the double-faced copy when the copying paper is about to be received within the tray 58.

The copying paper received inside the tray 58 is pulled out of the paper refeeding roller 38, forwarded by a pair of rollers 39, 40 via the feed paper path 34 to the timing roller 13, and subjected to image formation in the image-forming system 102.

(d) Multicolor copy mode

This copying machine operates also in a multicolor copy mode. The term "multicolor copy mode" is defined as reproduction of an image in different colors in a plurality of designated areas on one copying paper. In this mode, an image can be formed with a copying paper divided in two areas differing in color from each other or in three areas differing in color from one another across their boundaries.

Where a copying paper is composed of two areas as described above, the term "mode A" is defined as a mode in which an image is reproduced in a color other than black in the first part of the copying paper in the direction of scanning and other image in black in the remaining part of the copying paper and the term "mode B" as a mode in which an image is reproduced in black in the first part of the copying paper and other image in a color other than black in the remaining part of the copying paper. Where a copying paper is composed of three areas, the term "mode C" is defined as a mode in which an image is reproduced in black in the central part of the copying paper and other images are reproduced in colors other than black in the opposite terminal parts of the copying paper and the term "mode D" as a mode in which an image is reproduced in a color other than black in the central part of the copying paper and images are reproduced in colors other than black in the opposite terminal parts of the copying paper.

Figure 2:
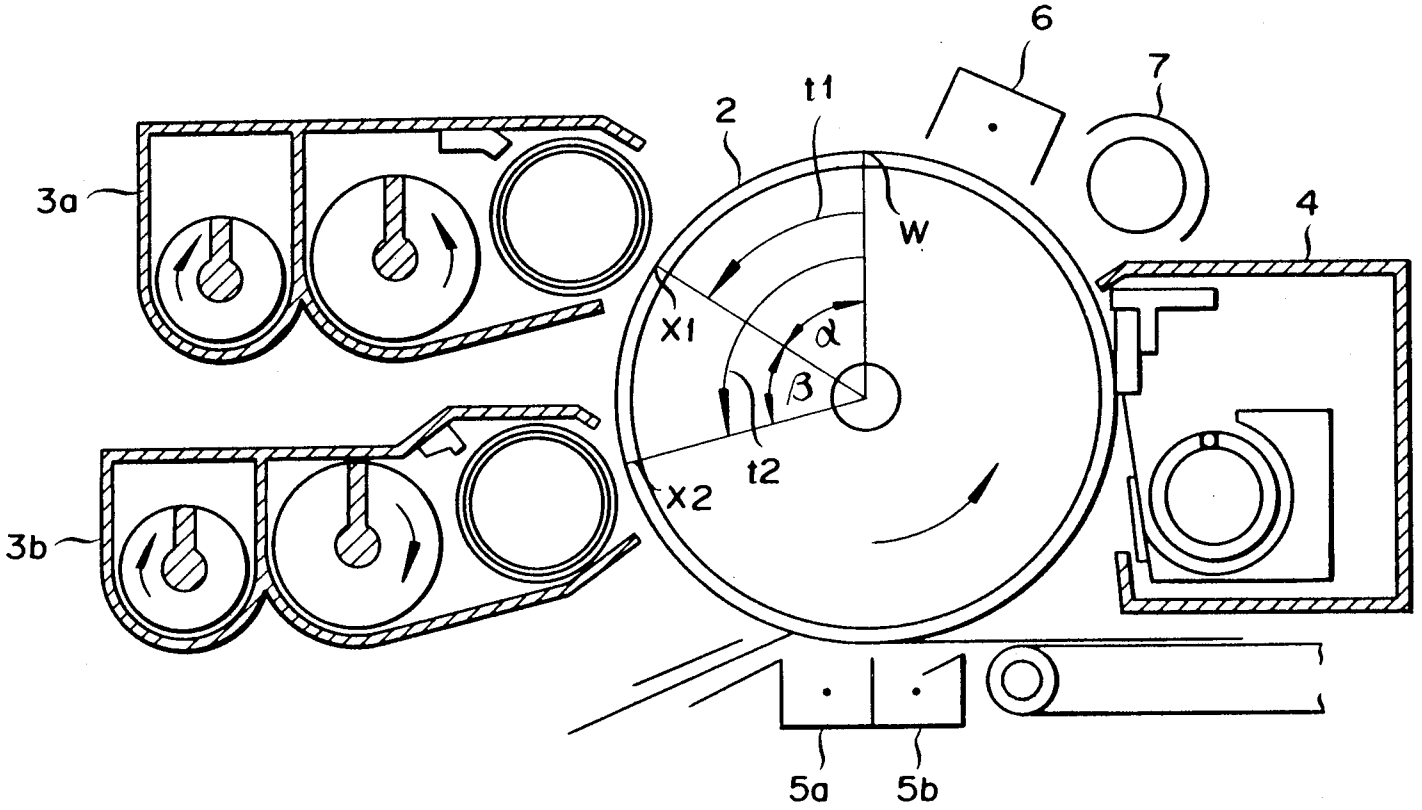
FIG. 2 is a magnified cross section of a photosensitive drum appearing in FIG. 1.

FIG. 2 is a diagram illustrating as magnified the photosensitive drum 2 and the peripheral components thereof appearing in FIG. 1. A black image is formed with the toner in the second developing device **3*b* and an image of a color other than black such as, for example, red is formed with the toner in the first developing device 3*a***.

Figure 3:
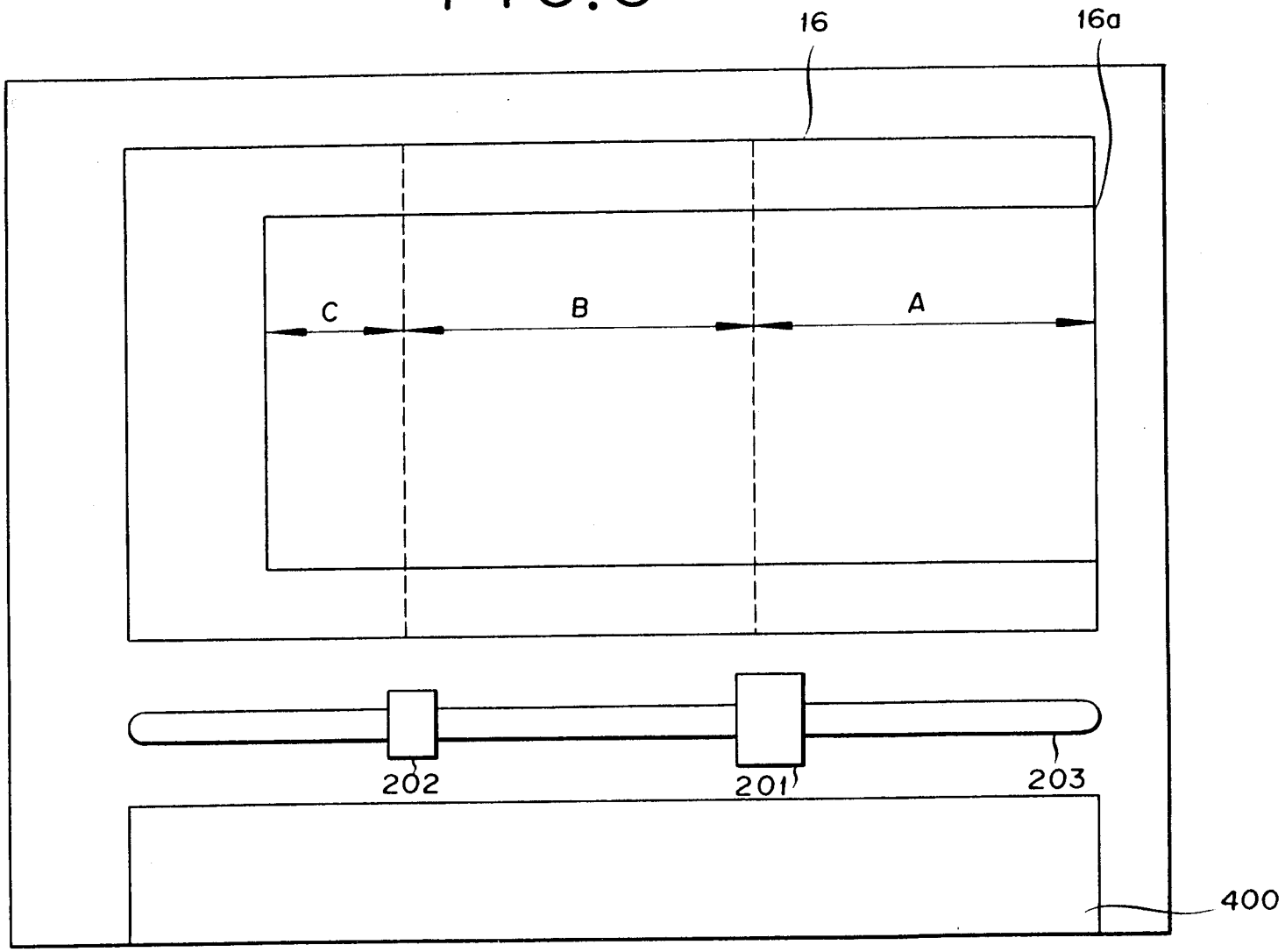
FIG. 3 is a plan view illustrating the upper surface of a copying machine shown in FIG. 1.

FIG. 3 is a top view of the copying machine appearing in FIG. 1. Between the glass table 16 and a control panel 400 a guide groove 203 is formed in the longitudinal direction or the direction of scanning. A first lever 201 and a second lever 202 are slidably attached to the guide groove 203. By the manipulation of these levers, the position of the boundary between the image areas can be set at will. The boundary, as indicated by a broken line in FIG. 3, is extended in the direction perpendicular to the direction of movement of the moving member 215 illustrated in FIG. 1, namely in the direction perpendicular to the direction of scanning. The reference numeral **16*a* in FIG. 3 denotes an area in which an image on an original document is reproduced. In this diagram, the area A represents an area defined by the leading end of the glass table 16 and the first lever 201, the area B an area defined by the first lever 201 and the second lever 202, and the area C an area defined by the second lever 202 and the trailing end of the original document area 16*a***.

Figure 4:
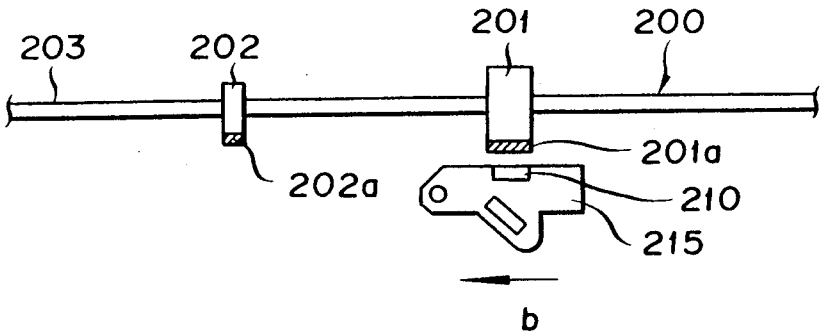
FIG. 4 is a schematic diagram illustrating the positional relation between a lever and a reed switch shown in FIG. 3 and adapted to control the operating timing of developing devices.

To permit detection of the positions of the boundaries to be set by the sliding of the levers 201 and 202, magnets **201*a* and 202*a* are attached to the lower parts of the levers as illustrated in FIG. 4. The moving member 215 shown in FIG. 4 is provided with a reed switch 210 adapted to be operated with the aforementioned magnets. When the moving member 215 is in the process of a scanning motion, the operating timing of the two developing devices is controlled by the reed switch 210 passing the positions of the magnets 201*a* and 202*a*. The arrow b in FIG. 4 indicates the direction of movement of the moving member 215** or the direction of scanning.

The light emitted from the optical system 101 and reflected by the original document impinges on the position of exposure W on the photosensitive drum 2 appearing in FIG. 1 and inscribes an electrostatic latent image at that position on the surface of the photosensitive drum 2. This position W in the actual copying machine does not fall directly above the photosensitive drum 2 but deflects leftward closely to the developing device **3*a*. In FIG. 2**, however, the position of exposure W is depicted as falling at a position directly above the photosensitive drum for the sake of the explanation.

In FIG. 2, the developing position of the first developing device 3*a* (the position at which the chain of toner formed on the surface of the developing sleeve is attached to the photosensitive drum 2) is indicated as "X1" and the developing position of the second developing device 3*b* as "X2," respectively. The position "X1" is specified by the angle, $\alpha$, and the time, t1, and the position "X2" by the angle, $\alpha+\beta$, and the time, t1+t2. The term "T1" as used therein refers to the time which any desired point on the surface of the photosensitive drum 2 rotating at a prescribed speed requires in travelling the distance from the position of exposure W to the developing position X1. The term "T2" as used herein refers to the time required by the same point in reaching the developing position X2.

Figure 5:
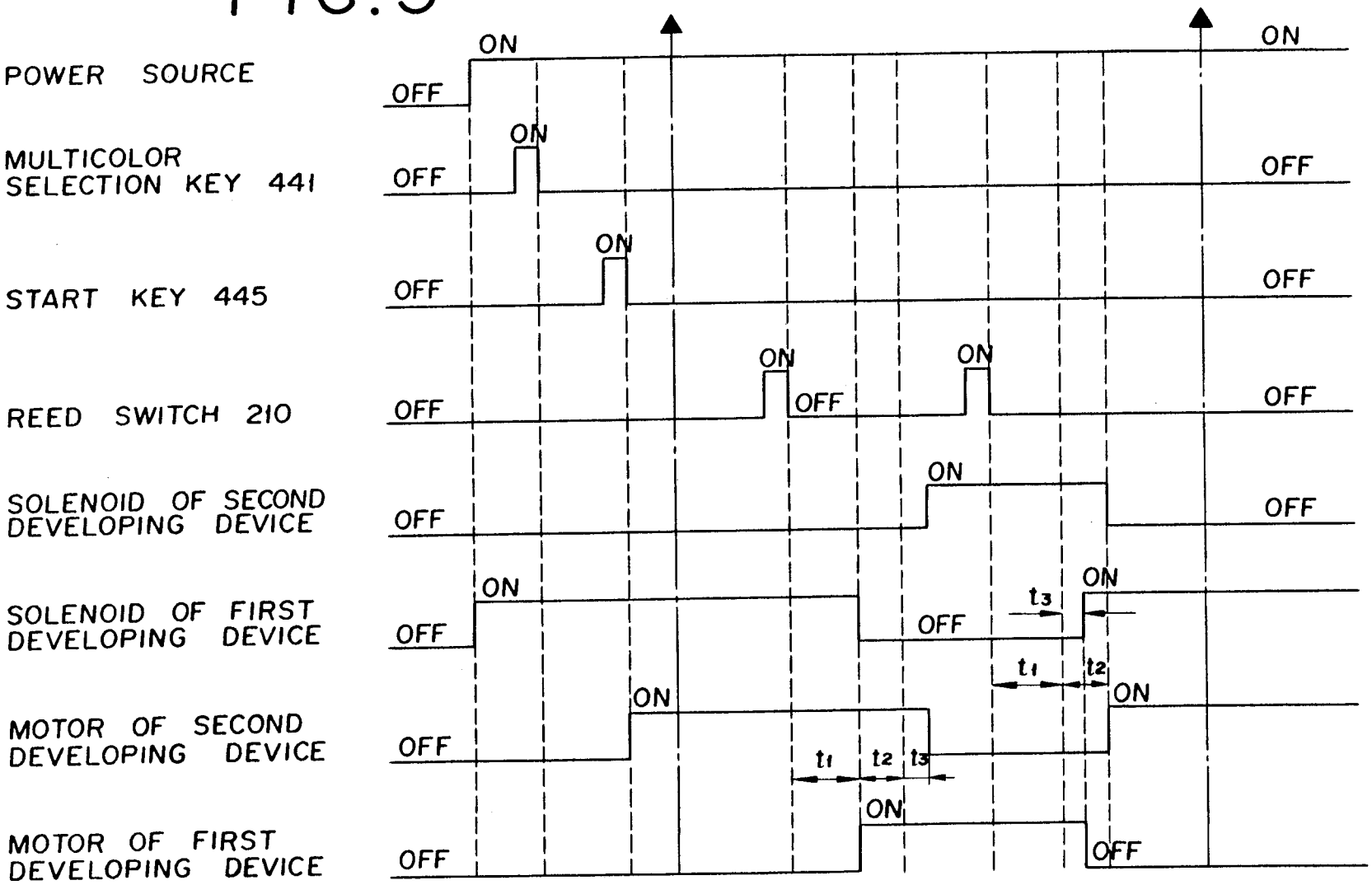
FIG. 5 is a time chart showing the ON-OFF timing of the two developing devices which occurs when the operating timing of the developing devices is controlled with the lever shown in FIG. 4.
Figure 6:
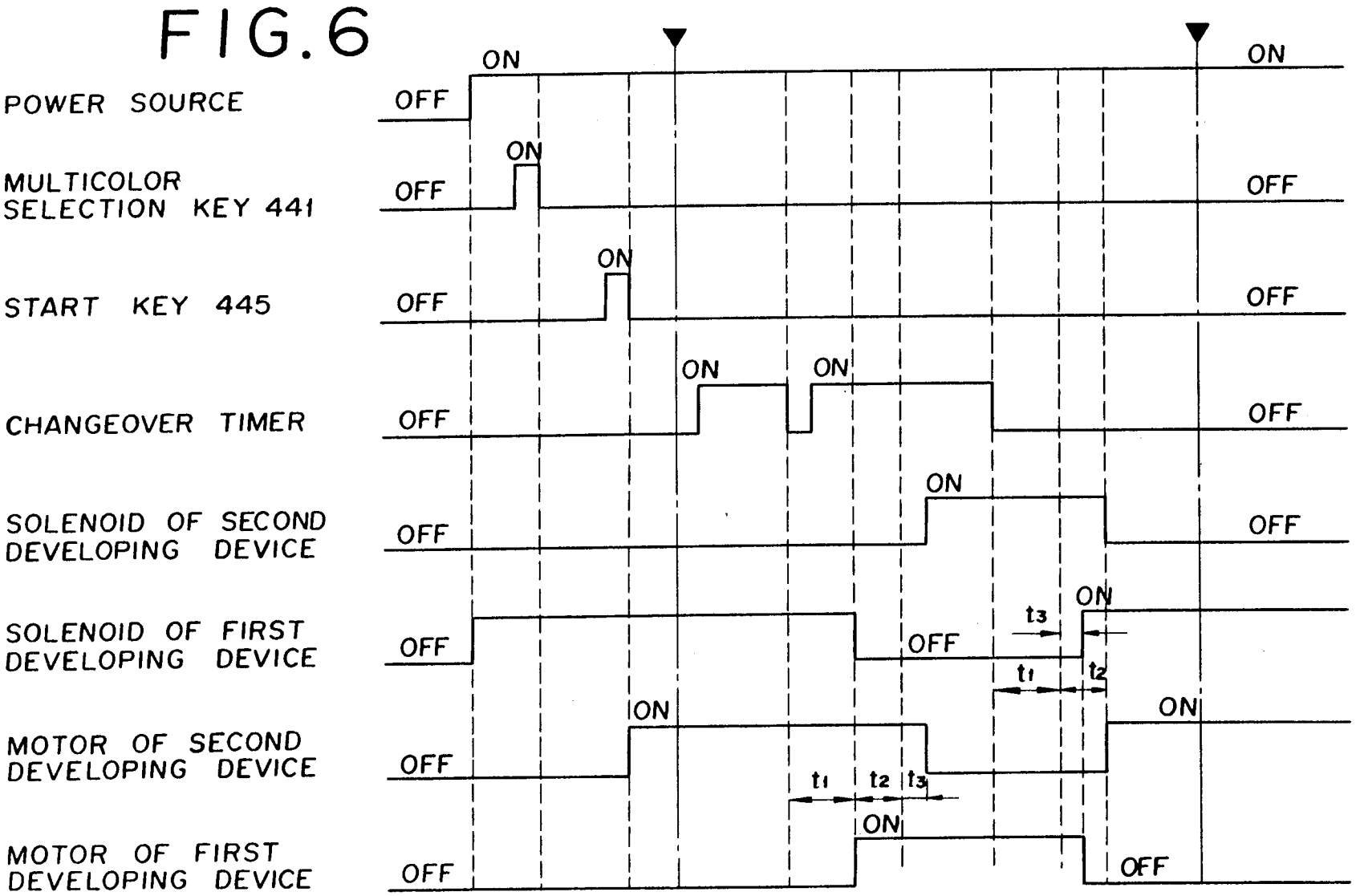
FIG. 6 is a time chart showing the ON-OFF timing of the two developing devices which occurs when the operating timing of the developing devices is controlled with a timer.

FIG. 5 and FIG. 6 are time charts indicating the operating timings of the first developing device 3*a* and the second developing device 3*b* while the copying machine is in the multicolor copy mode. FIG. 5 represents the case in which the areas, A to C, appearing in FIG. 3 are set by the levers 201 and 202. These areas, A to C, can be set by the IC card as specifically described hereinafter other than by the levers. FIG. 6 illustrates a time chart representing the case in which these areas are set by the IC card.

Figure 7:
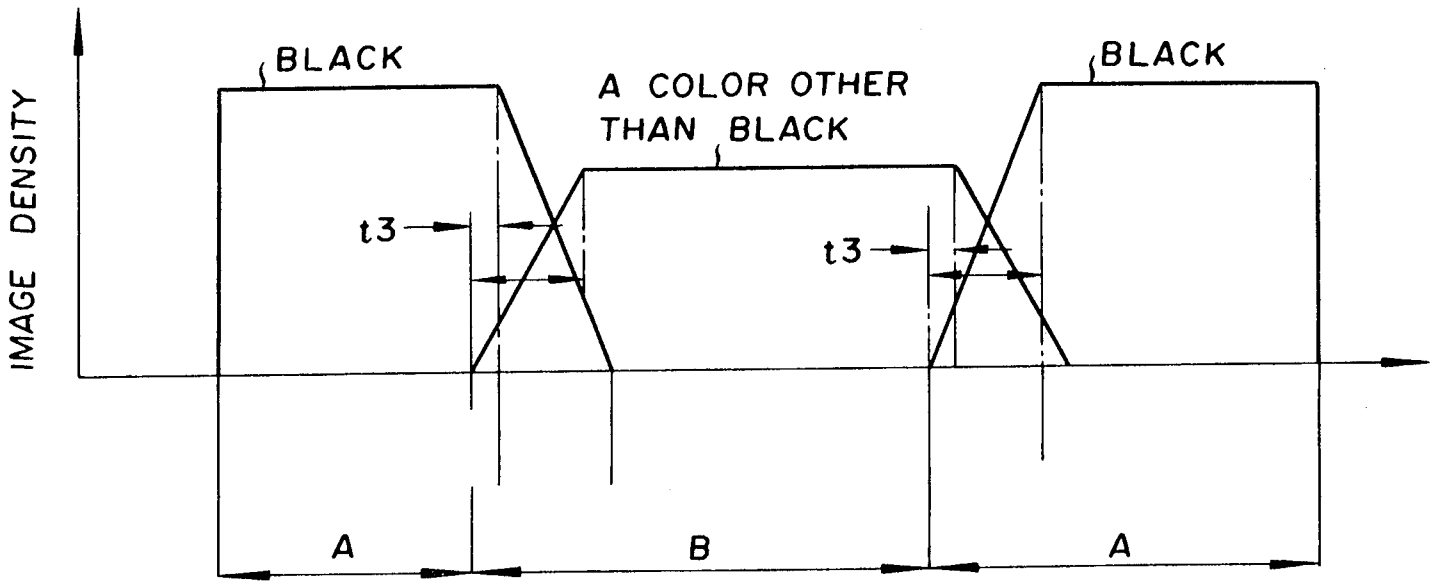
FIG. 7 is a diagram showing the relation between an image density and a switching timing at the time of switching of the developing devices.

FIG. 7 is a diagram illustrating the change of image density occurring during the operation in the mode D, with the boundaries between the areas as the centers.

When the power source of the copying machine is turned on, the solenoid (not shown) of the first developing device 3*a* containing the toner of a color other than black is turned on. As a result, the first developing device 3*a* is moved backward to the position of retraction. At this time, the solenoid of the second developing device 3*b* containing the toner of black remains in the OFF state and the second developing device 3*b* is in a position for allowing development. It is now assumed that in this state, the mode D is set by a depression given to mode keys 441 and 441*d* which will be described more specifically hereinafter. When an instruction to start copying is issued by a key 445, the motor for the second developing device 3*b* is turned on at the trailing edge of the instruction. As a result, there is set a state allowing development with the toner of black, namely a state allowing development of an electrostatic latent image formed on the surface of the photosensitive drum 2.

When a prescribed time elapses after the key 445 is turned on, the image on the original document begins to undergo scanning exposure. The development with the second developing device 3*b* is started when the time, t1+t2, required for the leading end of the original document to travel from the position of exposure W to the position of development X2 shown in FIG. 2 has elapsed. When the reed switch 210 disposed on the moving member 215 reaches the position of the lever 201 in consequence of the advance of the scanning exposure, this reed switch 210 is turned on. When the time, t1, elapses from the fall of the reed switch 210, the first developing device 3*a* containing the toner of a color other than black is advanced to the position for allowing development by the solenoid being turned on and, at the same time, the development with the first developing device 3*a* is started by the fact that the motor for the first developing device 3*a* is turned on. At this point, however, the development with the second developing device 3*b* is still in process. When the time, t2, elapses after the motor for the first developing device 3*a* is turned on, the development in the area A with the second developing device 3*b* is completed. In actuality, however, since the developing density in the boundaries is adjusted in consideration of the rise of the image density in a color other than black and the fall of the image density in black, the operation of the second developing device 3*b* is stopped by stopping the motor for the second developing device and, at the same time, the solenoid for the second developing device is turned on after elapse of the time, t3, after completion of the development.

When the reed switch 210 reaches the position of the lever 202 in consequence of the continuation of scanning, the reed switch 210 is turned on again. The formation of the image in a color other than black in the area B is completed when the time, T1, elapses from the trailing edge of the switch 210. Since the developing density in the boundaries is adjusted as illustrated in FIG. 7, the operation of the first developing device 3*a* is stopped by turning on the solenoid of the first developing device 3*a* and, at the same time, stopping the motor of the first developing device 3*a* after the time, t3, has elapsed from the completion of the formation of the image in the area B. On elapse of the time, t1+t2, from the trailing edge of the reed switch 210, the developing motion with the second developing device 3*b* is restarted to effect formation of an image in black in the area C.

The introduction as an input of the positions of boundaries of the areas, A to C, can be attained by the use of the IC cared as described above. In this case, the operating timing of the developing devices 3*a*, 3*b* is not controlled by the reed switch 210 but by the changeover timer as illustrated in FIG. 6.

(e) Control panel

Figure 8:
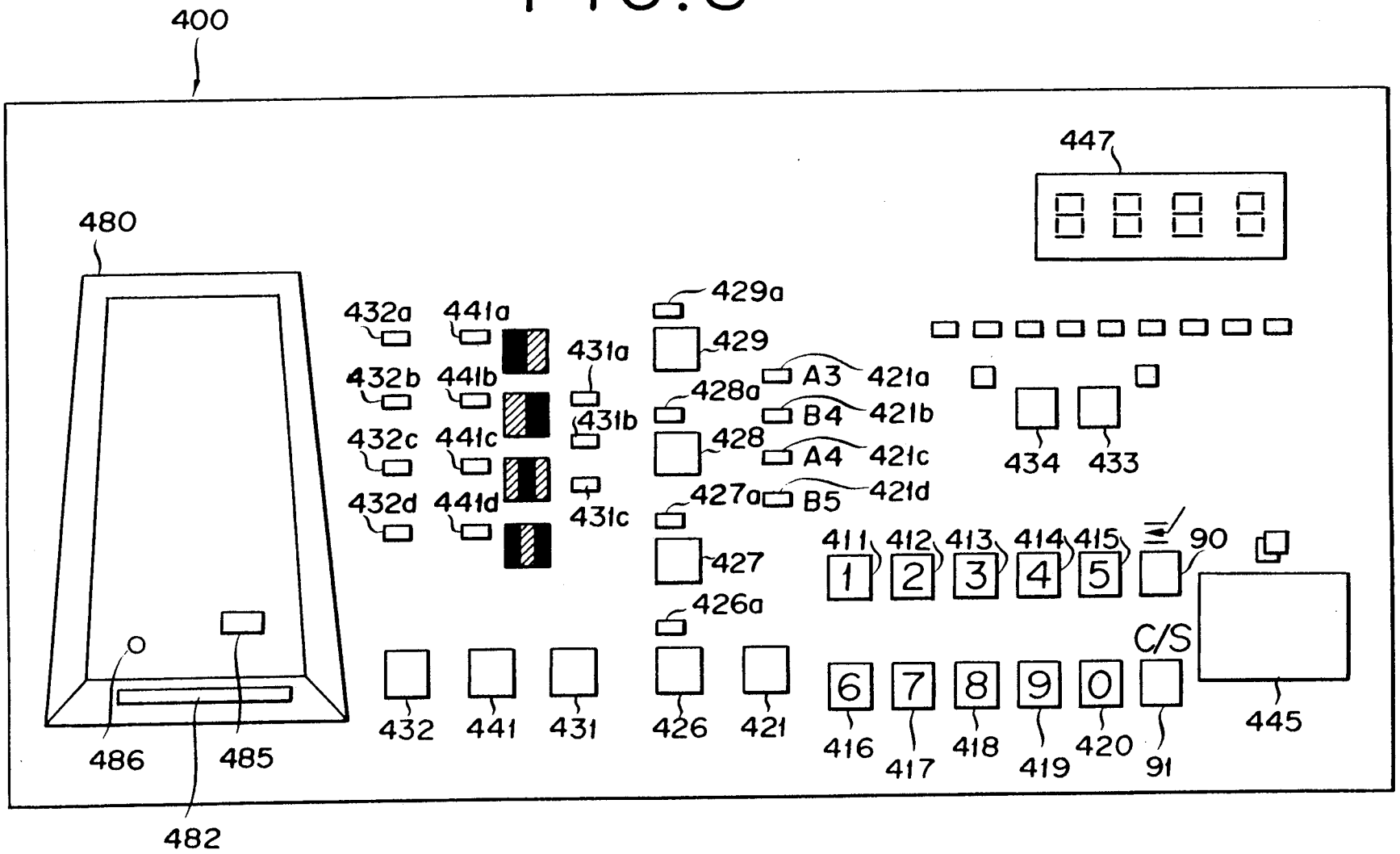
FIG. 8 is a plan view showing in detail a control panel for the copying machine appearing in FIG. 3.

FIG. 8 is a diagram illustrating in detail the control panel 400 appearing in FIG. 3.

In FIG. 8, the reference numerals 411 to 420 denote a ten-key pad for inputting the numerical data of "1 to 9" and "0" respectively, the reference numeral 90 denotes an interruption key for issuing an instruction to set an interrupt copy mode, the reference numeral 91 denotes a clear/stop key for issuing an instruction to clear the set copy mode and stop the copying motion, the reference numeral 445 denotes a start key for issuing an instruction to effect copy start, the reference numerals 433 and 434 denote an up key and a down key for issuing instructions to increase and decrease the amount of exposure as required for the adjustment of the density of the image to be reproduced, and the reference numeral 447 denotes a numeral display part for displaying such numerical data as the number of copying papers and the ratio of magnification of copying. The reference numeral 421 denotes a size selection key to be used in the selection of size of copying paper. The size of copying paper selected by depressing the key 421 is displayed by the glowing of a relevant one of LED 421*a* to 421*d* which are intended to display copying paper sizes. The reference numerals 426 to 429 denote keys which are used in making a selection from among a plurality of ratios of magnification of copying memorized in advance. The particular ratio of magnification so selected is displayed by the glow of a relevant one of LED 426*a* to 429*a*. The reference numeral 431 denotes a copy mode selection key for effecting a selection from among the one-face copy mode, the double-faced copy mode, and the composite copy mode. By depressing the key 431, a desired one selected from among LED 431*a* for displaying the selection of the one-face copy mode, LED 431*b* for displaying the selection of the double-faced copy mode, and LED 431*c* for displaying the selection of the composite copy mode is set glowing.

For the purpose of setting the multicolor copy mode mentioned above, the multicolor copy mode selection key 441 is operated. When this key 441 is depressed, a relevant one of LED 441*a* to 441*d* is shifted and set glowing. The LED 441*a* designates the selection of the aforementioned mode A from among the multicolor copy modes, the LED 441*b* that of the aforementioned mode B, the LED 441*c* that of the aforementioned mode C, and the LED 441*d* that of the aforementioned mode D.

The reference numeral 432 denotes a developing color selection key for the selection of the color of developing. By the depression of this key 432, a desired one of LED 432*a* to 432*d* for displaying developing colors is set glowing. Though the copying machine is capable of incorporating therein two developing devices at most, the developing devices are each interchangeable with other developing devices.

The control panel 400 is provided with an IC card setting part 480. This setting part 480 is provided with a load key 485 serving to load the IC card inserted through a card insertion mouth 482 formed in the setting part 480. When the IC card is set in place, the fact that a proper card has been set in place is displayed by the glow of an LED 486 for displaying card set.

(f) Edit input device

Figure 9:
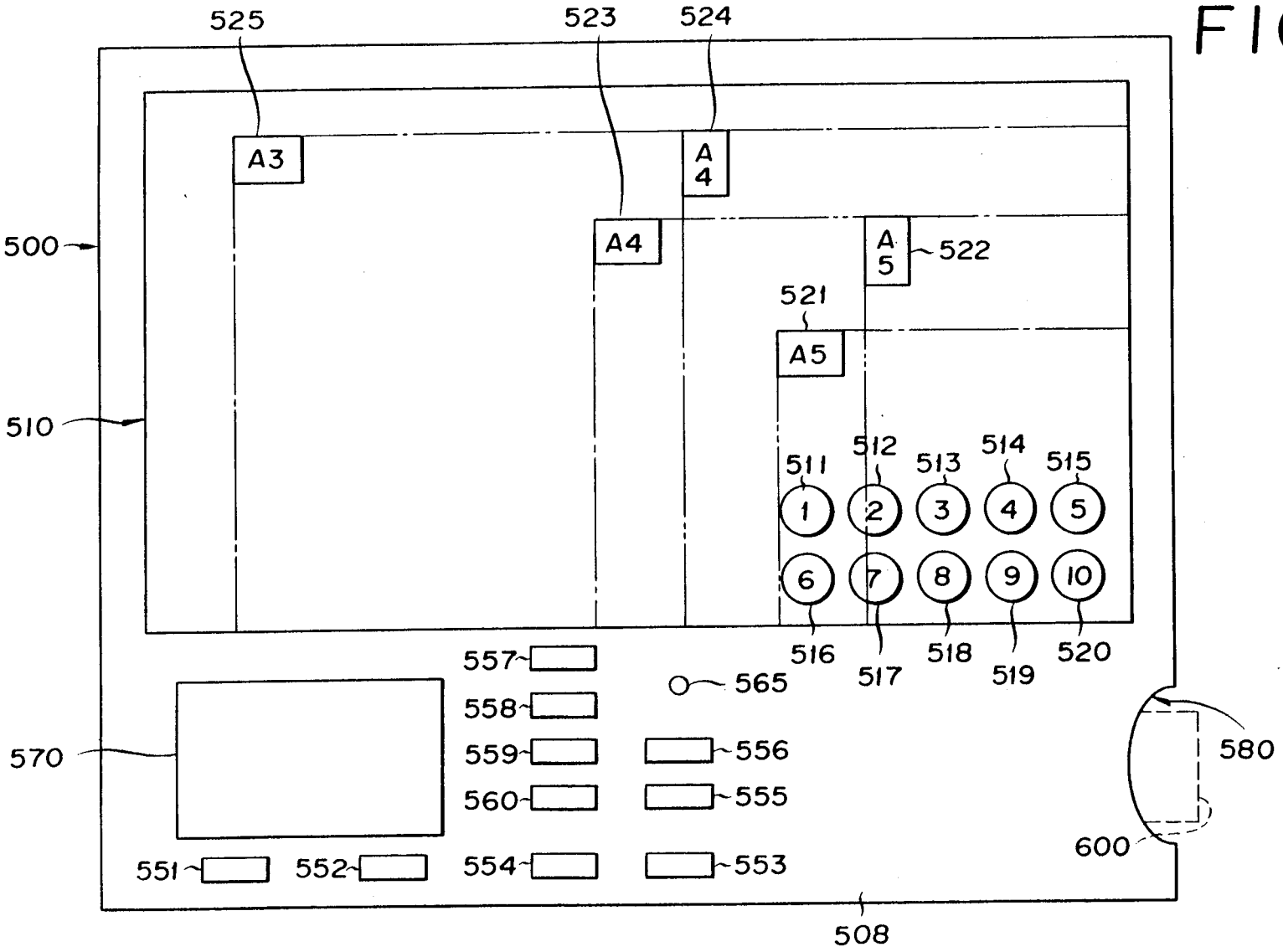
FIG. 9 is a plan view illustrating a typical original document edit input device as one embodiment of this invention.

FIG. 9 is a diagram illustrating the upper surface of an edit input device 500. This edit input device 500 is adapted to be connected through the medium of a cable to the control part of the copying machine. Alternatively, it may be installed independently, i.e. without being connected to the copying machine, by using a detachable memory media such as an IC card. The edit input device 500 comprises an operating panel 508, a tablet part 510, and an IC card insertion part 580.

The tablet part 510 is a panel surface capable of supporting a sheet of the largest allowable size, A3, in such a manner that the sheet has the longer side thereof in the longitudinal direction, i.e. in the left-to-right direction in the bearing shown in FIG. 9. When this tablet part 510 is depressed at a desired point, the coordinates data of that point concerning the longitudinal direction or the X-axis direction and the lateral direction or the Y-axis direction are introduced as an input.

This edit input device 500 is used in designating, in the information recorded on the original document, an area to be reproduced and an area not to be reproduced on a copying paper.

Ten-key marks 511 to 520 having numerals 1 to 0 respectively inscribed therein are printed or otherwise indicated on the aforementioned tablet 510. When any of these key marks is depressed, the numeric data of the depressed key conforming to the coordinates thereof are introduced as an input in conjunction with the coordinates data. The choice between reading the coordinates data of the key marks 511 to 520 and reading the numerical data is attained by manipulating a key disposed on the aforementioned operating panel and adapted as specifically described hereinafter. When the choice is made for reading the numerical data, the data to be read out are in the form of the number of copies. Further on the aforementioned tablet part 510, size marks 521 to 525 for permitting introduction of the size of copying paper as an input are printed or otherwise indicated. The mark 521 is to be depressed in selecting a copying paper having the length of A5, the mark 522 a copying paper having the width of A5, the mark 523 a copying paper having the length of A4, the mark 524 a copying paper having the width of A4, and the mark 525 a copying paper having the length of A3 respectively. When any of these marks is depressed, the relevant size data are introduced as an input in conjunction with the coordinates data. When the size mark is depressed, too, the choice between reading the coordinates data of the size mark and reading the size data is attained by manipulating a key installed on the operating panel 508. When the size data are read out, the size of the original document is inputted as an input through the tablet 510. At this time, the operator, by placing an original document on the tablet 510 and depressing the size mark corresponding to the original document, is enabled to input the size of a required copying paper and, at the same time, input the directions of length and width of the original document relative to the tablet as an input.

In FIG. 9, as copying paper sizes, those of A series are shown. Optionally, the edit input device may be adapted to use copying papers of sizes of B series or sizes in inches. The illustrated embodiment is configured to permit introduction as an input such numerical data as the size of copying paper and the number of copying papers by the manipulation of the tablet 510. The present invention is not limited to this configuration but may be configured so as to permit introduction of an input of such data as the ratio of magnification of copying and the amount of exposure, for example.

The operating panel 508 comprises key pads 551 to 560, an input terminal 565, and a liquid crystal display part 570. As illustrated, on the tablet of the image edit input device 500 of this invention, the ten-key marks 511 to 520 and the size marks 521 to 525 are printed or otherwise indicated. Since the relevant data can be injected as an input through the medium of this, the operating panel 508 is not required to be provided with any key switch for input and, therefore, allowed to attain a desirable dimensional reduction.

The key 551 is a first selection key and the key 552 is a second selection key and they are used in making a selection from among various modes such as, for example, the copy mode, the original document mode, the ratio of magnification of copying, the multicolor copy mode, and the edit mode which are displayed on the liquid crystal display part 570. The key 553 is a following screen key and the key 554 is a preceding screen key and they are manipulated in having a following screen and a preceding screen displayed on the liquid crystal display part 570. The key 555 is an operation guide key and is manipulated in having displayed on the liquid crystal display part 570 a procedure which the operator should follow in the operation of the edit input device. The key 556 is a clear key intended to clear the coordinates data and the modes inputted immediately before. The keys 557 to 560 are operation selection keys which are manipulated in selecting menus and modes such as, for example, pass word input mode and job input mode which are to be displayed on the liquid crystal display part 570.

This edit input device is activated when a memory card or an IC card 600 is inserted in the IC card insertion part 580 mentioned above. In the IC card 600, the copy data set by the edit input device are stored.

In the illustrated embodiment, the edit input device is configured so that the ten-key marks 511 to 520 and the size mark 525 are indicated on the tablet 510. Optionally, part or all of the plurality of keys disposed on the operating panel 518 may be formed on the tablet 510. In this case, the image edit input device 500 may be given a desirable dimensional reduction without requiring any decrease in the size of the tablet 510.

(g) Controller

FIG. 10 is a block diagram illustrating the configuration of a control circuit of the copying machine. This controller is provided with a CPU 401 for controlling the basic operation of the copying machine. To this CPU 401 are connected a CPU 491 for controlling the movement of a scanner and the adjustment of lens position in the aforementioned optical system 101 and CPU 492 for severally controlling the ON-OFF switching of the LED elements of the LED array 1040. Further to the CPU 401, a ROM 402, a RAM 403 backed up with a battery, a parallel I/0 interface 404, and an IC card I/F interface 481 are connected through the medium of an address data bus. The ROM 402 has the control program for the CPU 401 stored therein and the RAM 403 is used for the purpose of working. Into the parallel I/0 interface 404, the data for the operation of the keys disposed on the control panel 400 illustrated in FIG. 8 are inputted and the signals from the sensors disposed inside the copying machine such as, for example, the sensors of the reed switch 210, are inputted. For the purpose of controlling the operation of the motors, clutches, solenoids, etc. within the copying machine, control signals are forwarded to these component parts through the medium of the parallel 1/0 interface 404.

The data recorded in the IC card 600 which is inserted in the card setting part 480 are forwarded to the CPU 401 through the medium of the card interface 481.

Figure 11:
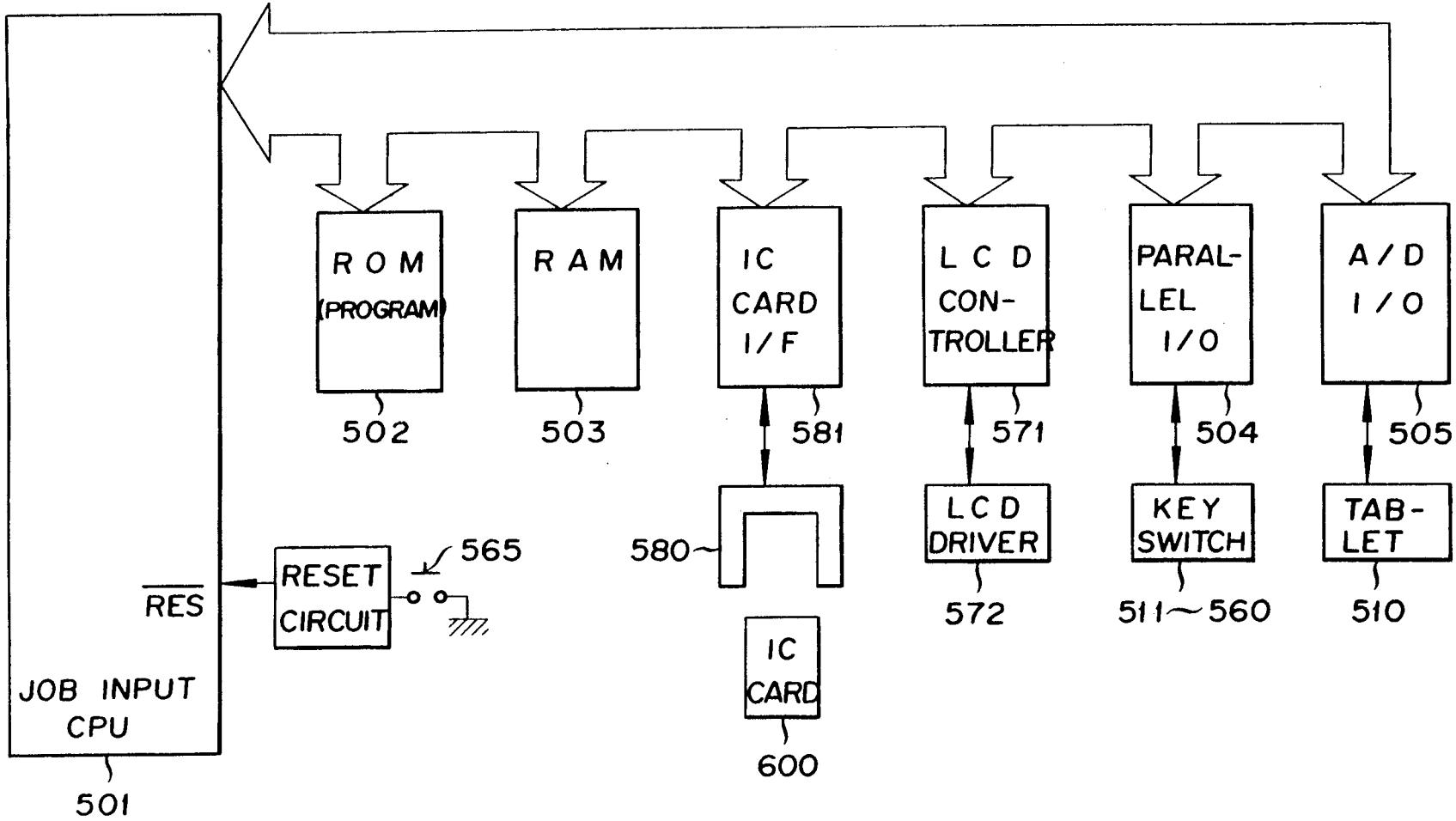
FIG. 11 is a block diagram illustrating a control circuit of the original document edit input device of this invention.

FIG. 11 is a block diagram illustrating the configuration of a control circuit for controlling the operation of the edit input device 500.

This controller is provided with a CPU 501. To this CPU 501, a ROM 502 storing such data as control program and display for the CPU 501, a RAM 503 used for the purpose of working, an IC card I/F interface 581, a LCD controller 571 for controlling the drive of the liquid crystal display part 570, a parallel I/0 interface 504 for admitting and preserving the state of the key switches 511 to 560 on the operating panel 508, and an A/D and I/0 interfaces 505 for admitting the input state of the key marks of the tablet 510 and preserving the input data are connected through the medium of a bus.

The operation of the CPU 501 is reset by turning on a reset terminal 565.

(h) Operation

Now, the operation of the copying machine based on the processing with the CPU 401 will be described below with reference to the flow charts shown in FIGS. 12 to 16.

Figure 12:
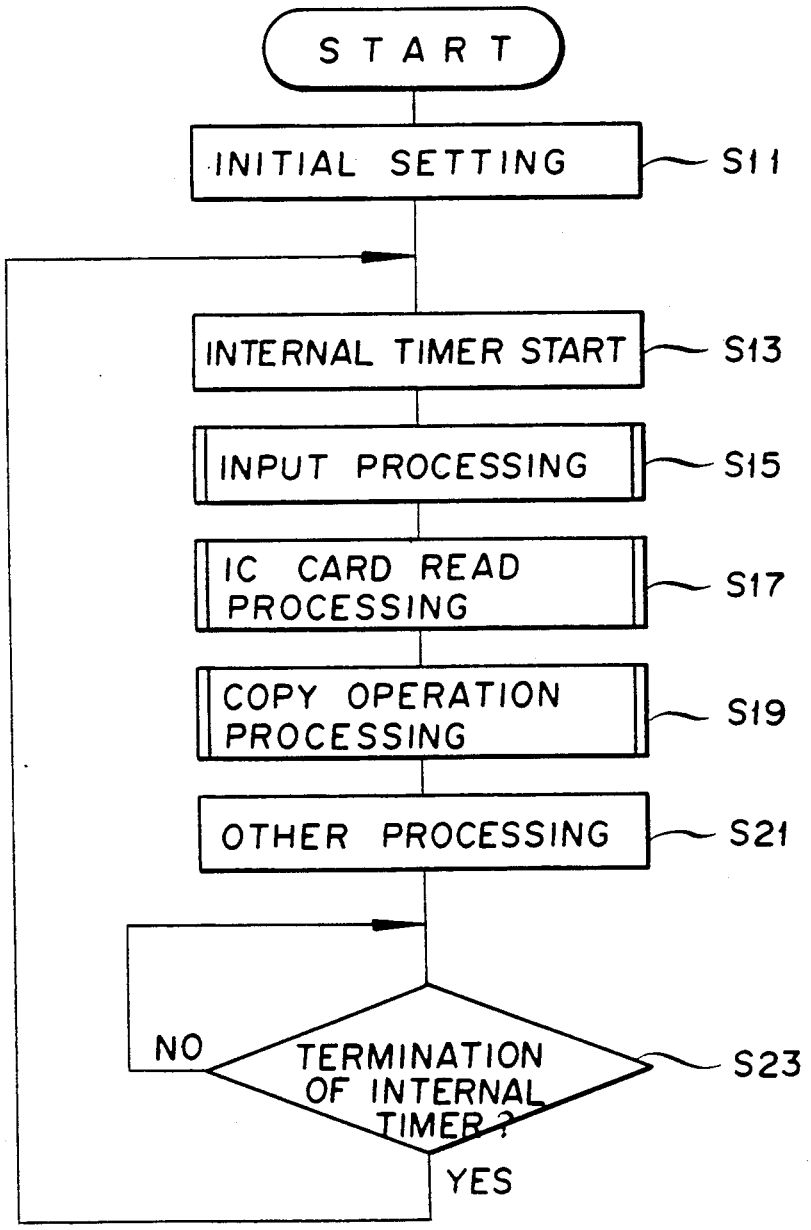
FIG. 12 is a flow chart illustrating the main routine of the processing with CPU 401 of the copying machine.

FIG. 12 is a flow chart illustrating a main routine of the processing with the CPU 401 for controlling the operation of the copying machine. This CPU 401 starts the processing as when the power source thereof is turned on and then executes the initial setting at the step S11. At the step S13, the internal timer for defining the time for the execution of one routine is started. Thereafter, the operation input processing (the step S15), the IC card read processing (the step S17), the copy operation processing (the step S19), and the other processing (the step S21) are executed. When termination of the clocking with the internal timer is sensed in the step S23, the processing is returned to the step S13 and the processings mentioned above are repeated.

Figure 13:
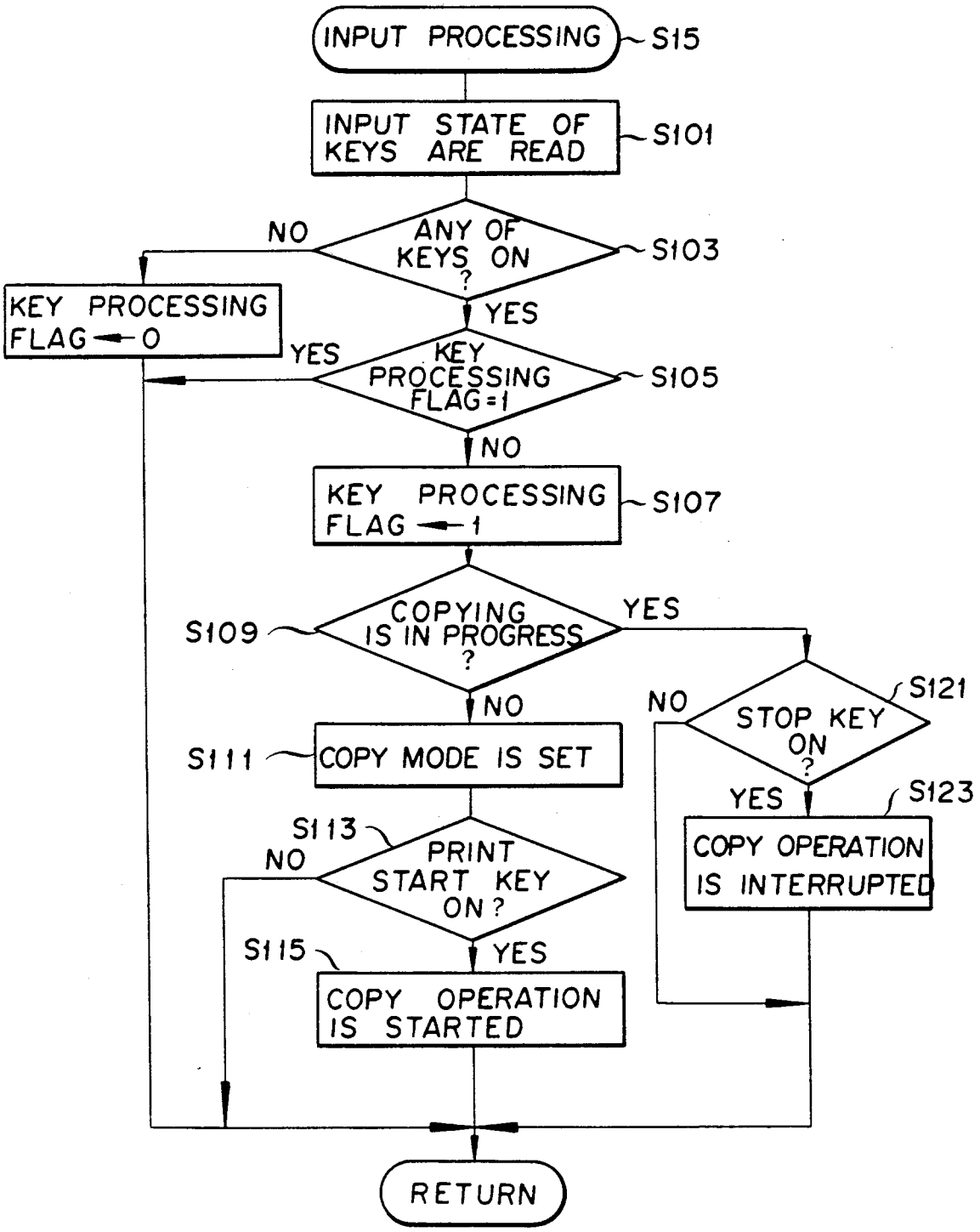
FIG. 13 is a flow chart illustrating the sub-routine of the operation input processing appearing in FIG. 12.

FIG. 13 is a flow chart illustrating a subroutine of the processing of the input at the aforementioned step S15. At the step S101, the input state of the key switches on the control panel 400 shown in FIG. 8 are read in. As a result, a key processing flag is set at the step S107 when the fact that any of the key switches has been depressed is discerned at the step S103 and the fact that no key processing flag has been set is discerned at the step S105. At the step S109, the decision as to whether or not the copying operation is in progress is made. When this decision draws a negative answer, a copy mode corresponding to the key switch operated at the step S111 is set. When the fact that the key which has been turned on is the start key 445 of FIG. 8 is discerned at the step S113, the copy operation is started at the step S115. When the fact that the copy operation is in progress is discerned at the step S109, the decision as to whether or not the key which has been operated is the stop key 91 is made at the step S121. When the decision draws an affirmative answer, the copy operation is interrupted at the step S123. When the fact that none of the key switches has been set operating is discerned at the step S103, the key processing flag is reset at the step S131 and the processing is returned to the main routine. Even when the decision at the step S103 draws YES as an answer and any of the key switches has been set operating, YES is drawn as an answer at the step S105 and the processing is returned in its unmodified form to the main routine so long as the processing for the on edge is being executed.

Figure 14:
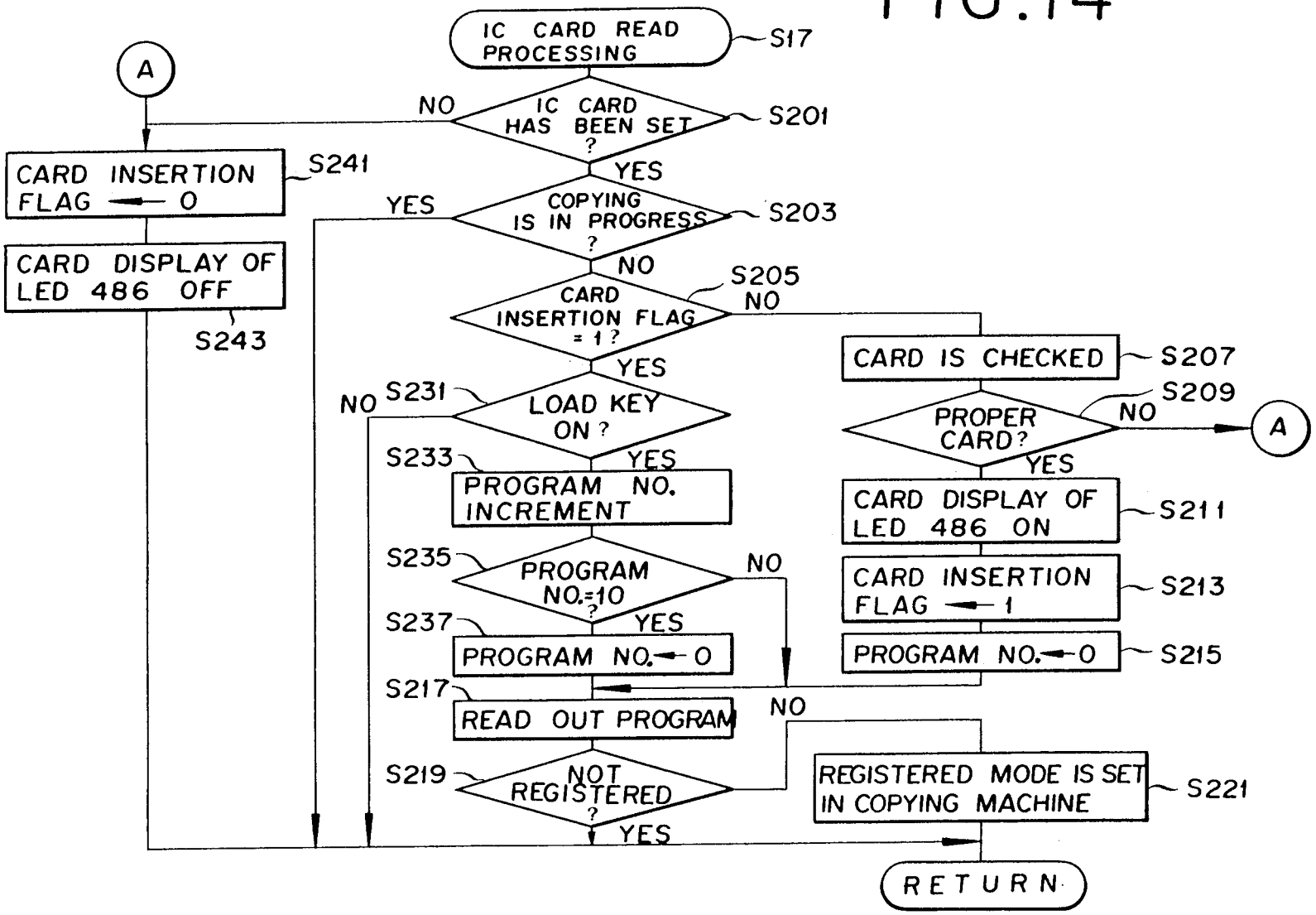
FIG. 14 is a flow chart illustrating the sub-routine of the IC card read processing appearing in FIG. 12.

FIG. 14 is a flow chart illustrating a sub-routine of the IC card read processing appearing at the step S17 of FIG. 12. At the step S201, the decision as to whether or not the IC card 600 has been set in place in the card setting part 480 of the control panel 400 shown in FIG. 8. When the IC card is found to have been set in place at this step and the copy operation is found to be in progress at the step S203, the necessity for setting the card insertion flag is discerned at the step S205. When the card insertion flag has not been set, NO is drawn as an answer by the decision at the step S205 and the question as to whether or not this card is proper is decided at the step S207. When the fact that a proper card has been inserted is discerned at the step S209, the LED 486 for card set display on the control panel 400 is set glowing at the step S211. The card insertion flag is put up at the step S213 and "0" is set in the program number at the step S215. Then, the contents of the program number which has been set are read out at the step S217 and the registered mode is set in the copying machine at the step S221 on the condition that the contends have been registered (NO at the step S219).

When YES is drawn as an answer by the decision at the step S205 and the fact that the card insertion flag has been set, namely the fact that the processing during the course of card insertion has been perfected, is discerned, the load key awaits operation. When the fact that the load key 485 has been set operating is discerned, the value of the program number is sequentially increased at the step S233 each time this key is manipulated. When the fact that the value of the program number has reached "10" in consequence of the increment is discerned at the step S235, the program number is reset to "0" at the step S237. Subsequently, the contents of the corresponding program number are read out and the mode consequently read out is set in the copying machine. This processing is executed in the same manner as when the card insertion is carried out at the steps S217, S219, and S221. When the fact that the IC card 600 has not been set is discerned at the step S201 or when the IC card has been set and this IC card is not found to be a proper card at the step S209, the card insertion flag is reset at the Step S241 and the card display of LED 486 is turned off at the step S243.

Figure 15:
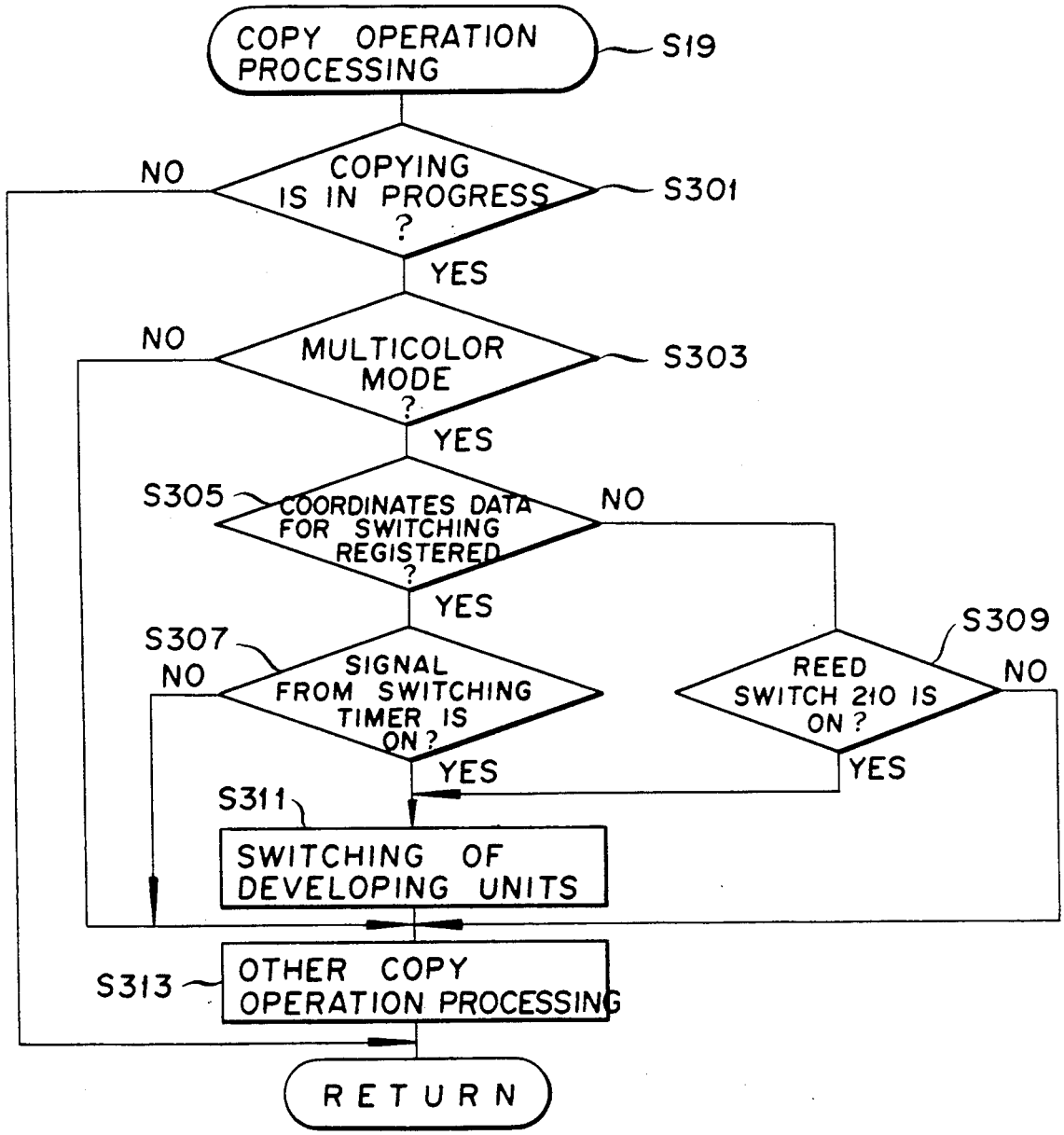
FIG. 15 is a flow chart illustrating the sub-routine of the copy operation processing appearing in FIG. 12.

FIG. 15 is a flow chart illustrating a sub-routine of the copy operation processing indicated at the aforementioned step S19. At the step S301, the decision as to whether or not the copy operation is in progress is made. When this decision draws an affirmative answer at this step, the decision as to whether or not the multicolor mode has been set is made at the step S303. When this decision draws an affirmative answer at the step S303, the decision is now made at the step S305 as to whether or not the coordinates data for determining the timing for switching the developing colors have been registered in the mode data loaded from the IC card 600. This registration of the coordinates data in the IC card 600 is carried out at the step S1363 (FIG. 24) which will be described specifically hereinafter. When the fact that the coordinates data have been registered is discerned at the step S305, the switching of developing devices is effected based on the registered data at the step S311 at the time that the signal from the timer is found to be transmitted at the step S037 and the ON-OFF state of the developing devices are controlled by the timing shown in FIG. 6.

Conversely, when NO is drawn as an answer by the decision at the step S305 and the coordinates data are not found to have been registered, the switching of developing devices is controlled at the step S311 on the condition that the fact that the reed switch 210 has been turned on is discerned at the step S309. The step S313 is where the copy operation processing other than the switching of developing devices is collectively displayed.

Figure 16:
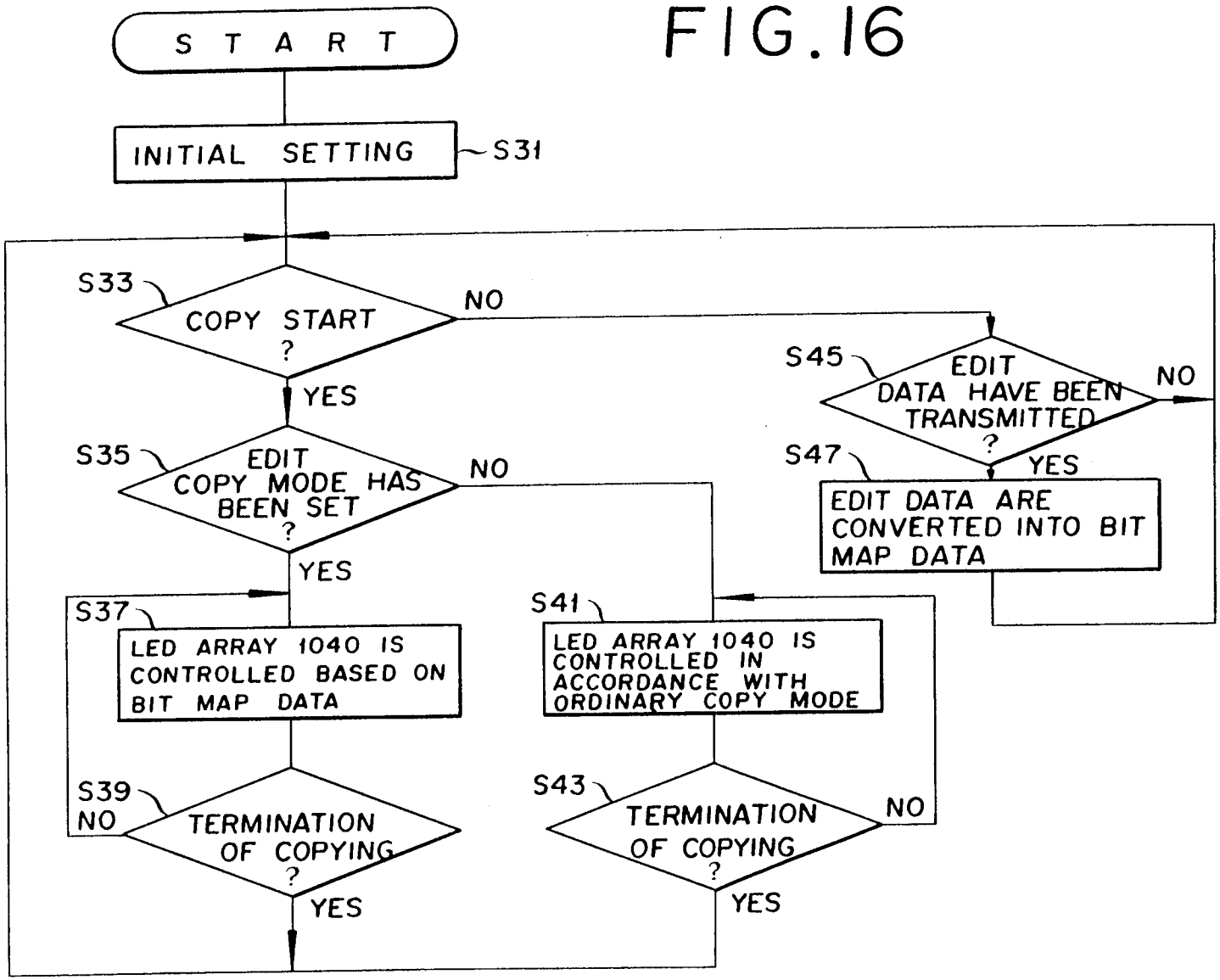
FIG. 16 is a flow chart illustrating the main routine of the processing with CPU 492 of the copying machine.

FIG. 16 is a flow chart illustrating the processing with the CPU 492 shown in FIG. 10 for the control of the operation of the LED array 1040. As illustrated in the diagram, the processing is started as by power source connection and then the initial setting is carried out at the step S31. When NO is drawn as an answer by the decision at the step S33, namely when the fact that the instruction to start copying is awaited is discerned, the decision is made at the step S45 as to whether or not the edit data have been transmitted from the CPU 401. When this decision draws an affirmative answer, the edit data are converted at the step S47 into bit map data for controlling the ON-OFF state of the LED elements of the LED array 1040. When the instruction to start the copy operation is sensed at the step S33, the decision is made at the step S35 as to whether or not the edit copy mode has been set. When this decision draws an affirmative answer, the ON-OFF control of the LED elements of the LED array 1040 is effected at the step S37 based on the bit map data developed at the step S47. When the decision made at the step S35 draws a negative answer, the LED array 1040 is operated as an mid-image eraser in accordance with the ordinary copy mode.

The copying machine is controlled as described above in accordance with the mode introduced through the medium of the control panel 400 or the mode loaded through the medium of the IC card 600.

Then, the procedure to be followed for the operation of the edit input device illustrated in FIGS. 9 to 11 will be described below with reference to the flow charts shown in FIGS. 17 to 27.

Figure 17:
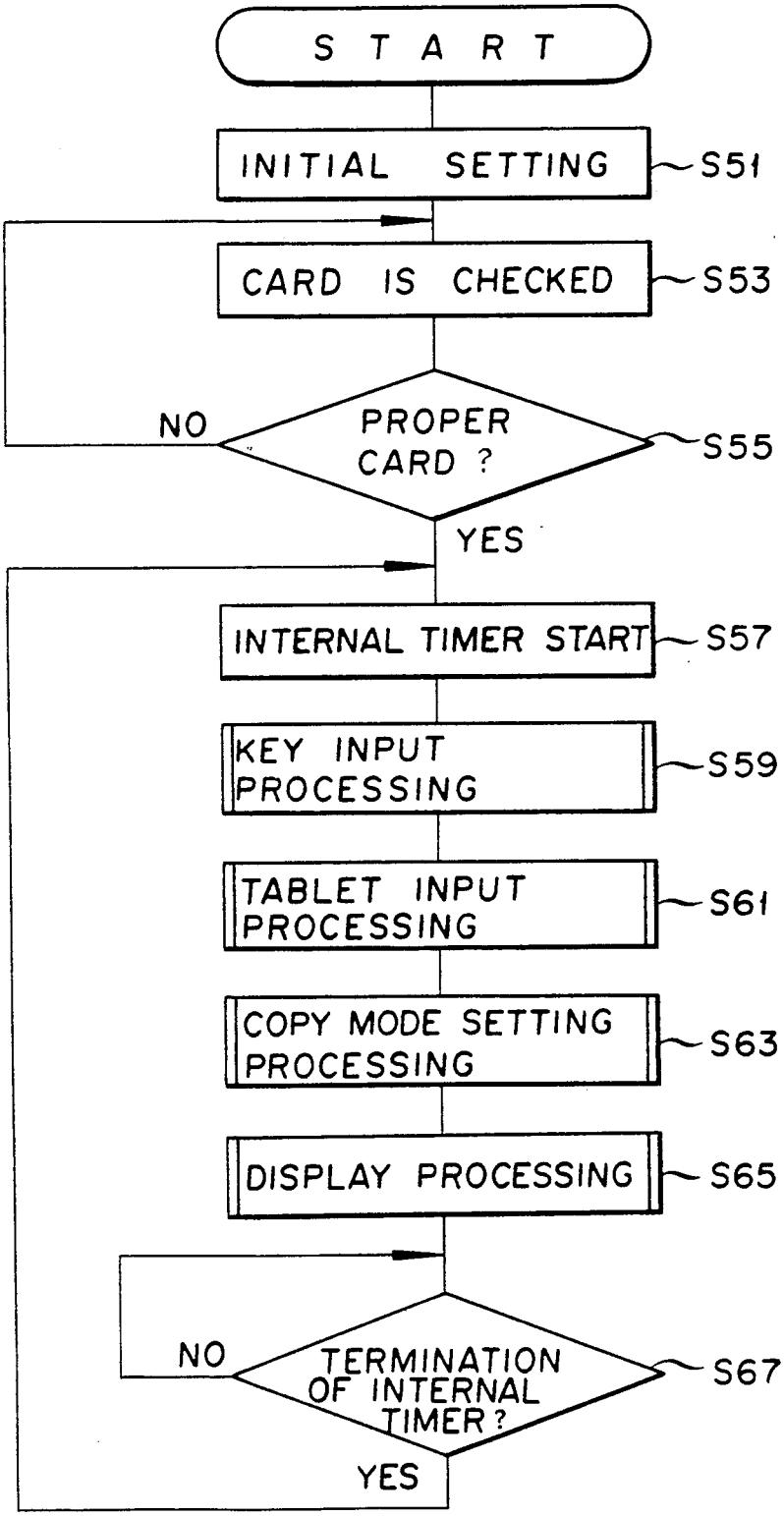
FIG. 17 is a flow chart illustrating the main routine of the processing with CPU 501 of the edit input device of the present invention.

FIG. 17 is a flow chart illustrating a main routine of the processing with the CPU 501 for the control of the operation of the edit input device. This CPU 501 starts the processing as by power source connection and effects the initial setting at the step S51. At the step S53, the decision is made as to whether or not the inserted IC card is a proper card. When this decision draws an affirmative answer at the step S55, the processing is executed at the step S57. At this step S57, the internal timer for determining the time for executing one routine is started. Subsequently, the key input processing at the step S59, the tablet input processing at the step S61, the copy mode setting processing at the step S63, and the display processing at the step S65 are executed. When termination of the clocking of the internal timer is discerned at the step S67, the processing is returned to the step S57 and the processings described above are repeated.

Figure 18:
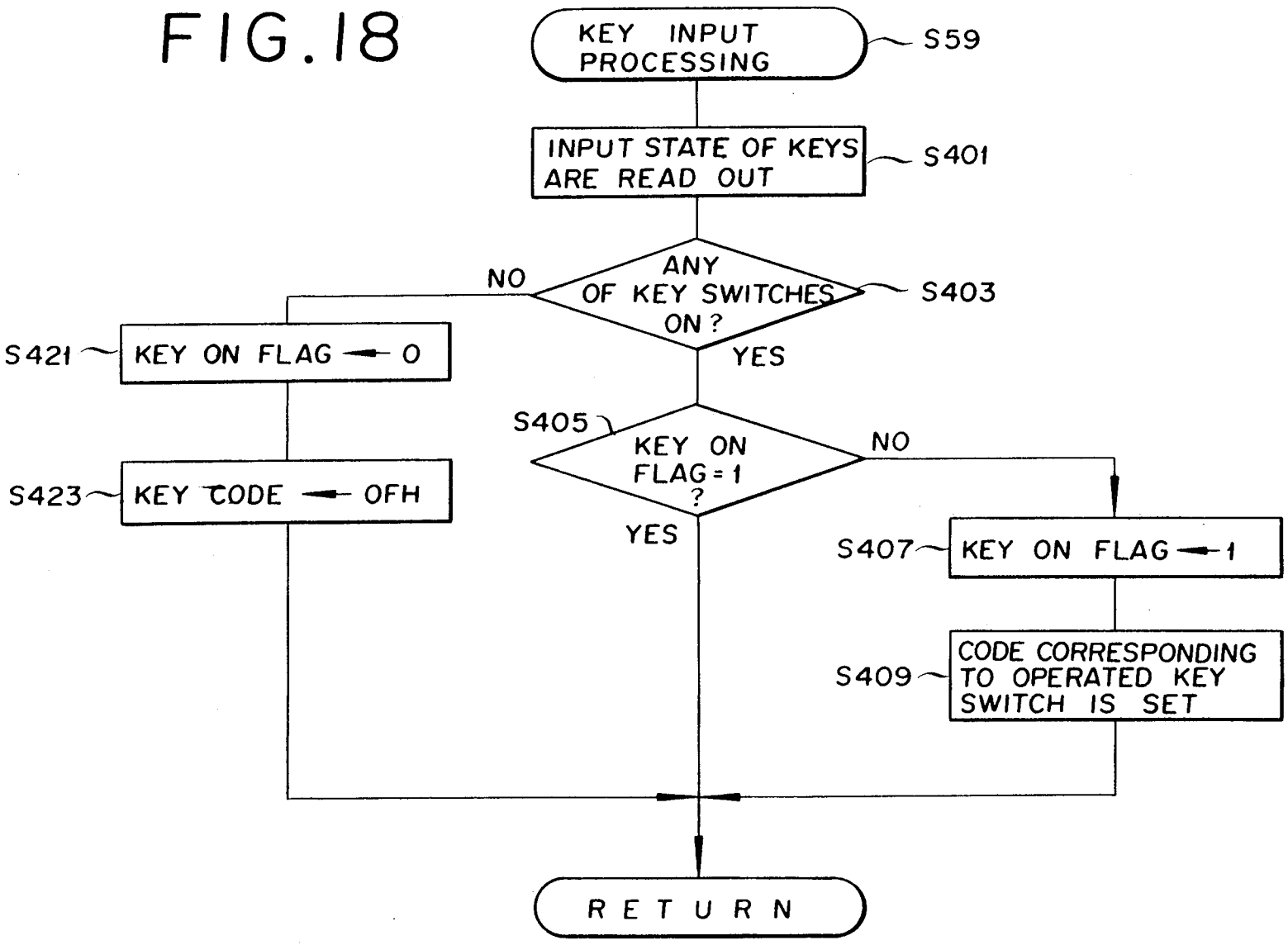
FIG. 18 is a flow chart illustrating the sub-routine of the key input processing appearing in FIG. 17.

FIG. 18 is a flow chart illustrating a sub-routine of the key input processing indicated in the aforementioned step S59. At the step S401, the state of the key switches installed on the operating panel 508 of the edit input device are read out At the step S403, the decision is made as to whether or not any of the key switches has been turned on. When this decision at the step S403 draws an affirmative answer, the decision is made at the step S405 as to whether or not the key on flag has been already set. When this decision at the step S405 draws a negative answer, the key on flag is set at the step S407 and the code corresponding to the operated key switch is set in the key code. In contrast, when the decision made at the step S405 draws a negative answer, namely when the fact that the processing for the operated key switch has been, already completed is discerned, the processing is returned in its unmodified form to the main routine. When the fact that the key switch has not been turned on is discerned at the step S403, the key on flag is reset at the step S421 and the code "OFH" is set in the key code at the step S423. This code indicates that the key switch has not been manipulated.

Figure 19:
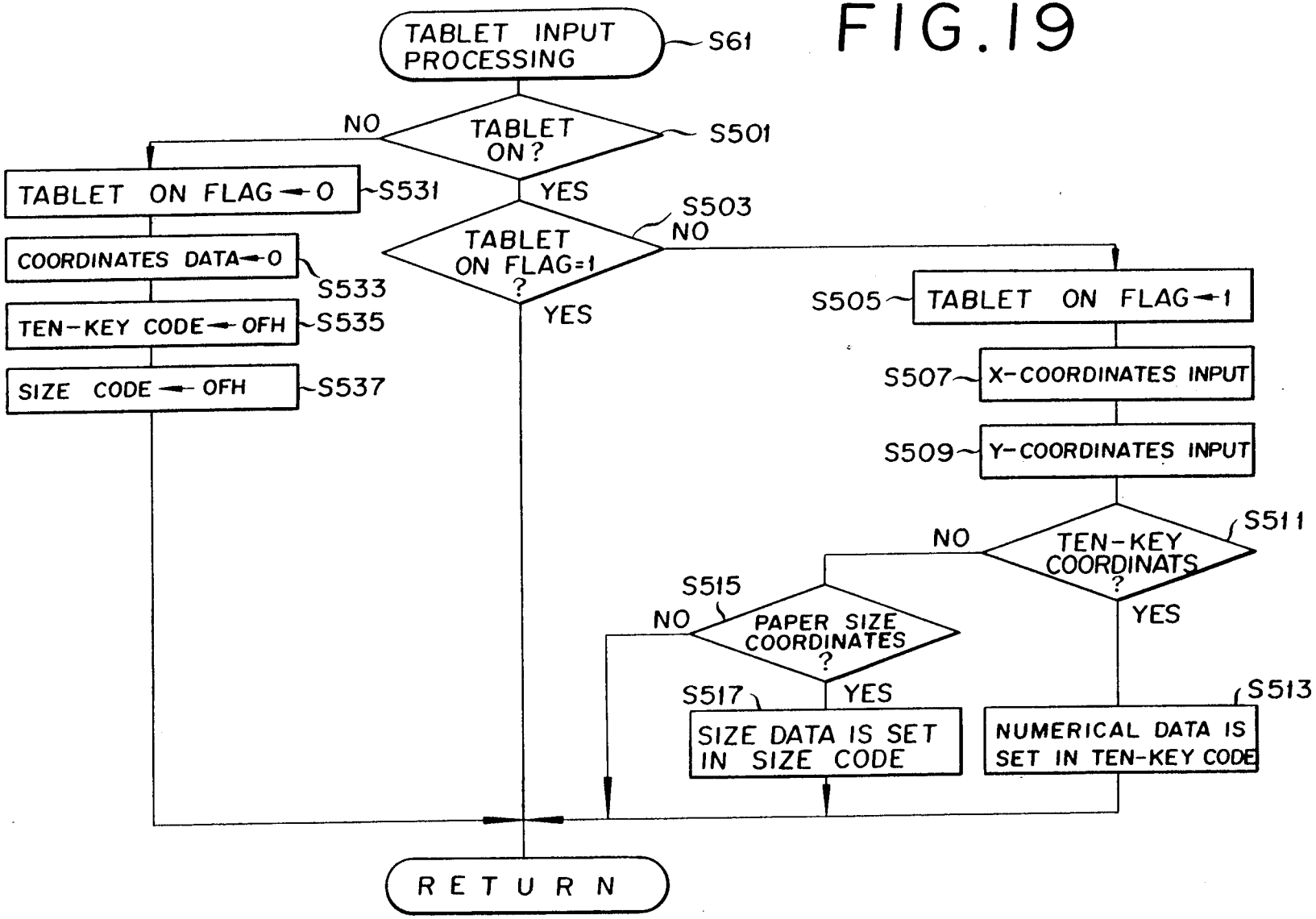
FIG. 19 is a flow chart illustrating the sub-routine of the tablet input processing appearing in FIG. 17.

FIG. 19 is a flow chart illustrating the tablet input processing at the step S61 shown in FIG. 17. When the fact that any of the key marks of the tablet part 510 shown in FIG. 9 has been depressed is discerned at the step S501, the decision is made at the step S503 as to whether the tablet on flag has been already set. When this decision at the step S503 draws a negative answer, the tablet on flag is set at the step S505 and the X coordinates value and the Y coordinates value at the depressed position are injected as an input.

When the fact that the position of the depressed part mentioned above falls on any of the ten-key marks 511 to 520 shown in FIG. 9 is discerned at the step S511, the numerical data concerning this position are set on the ten-key code at the step S513. When the fact that the position of the depressed part falls on any of the key marks 521 to 525 indicating the copying paper size shown in FIG. 9 is discerned at the step S515, the size data concerning this position is set in the size code at the step S517. When the fact that the tablet on flag has not been set is discerned at the step S503, this fact means that the processing effected when any of the key marks of the tablet 510 is depressed has been completed. Thus, the processing is returned in its unmodified state.

When the fact that none of the marks on the tablet 510 has been depressed is discerned at the step S501, the tablet on flag is reset at the step S531 and the coordinates data are cleared at the step S533. Further, at the step S535 and the step S537, the "OFH" code indicating that none of the marks of the tablet 510 has been depressed is set in the ten-key code and the size code.

FIGS. 20 to 26 are flow charts each illustrating a sub-routine of the copy mode setting processing indicated at the step S63 of FIG. 17.

Figure 20:
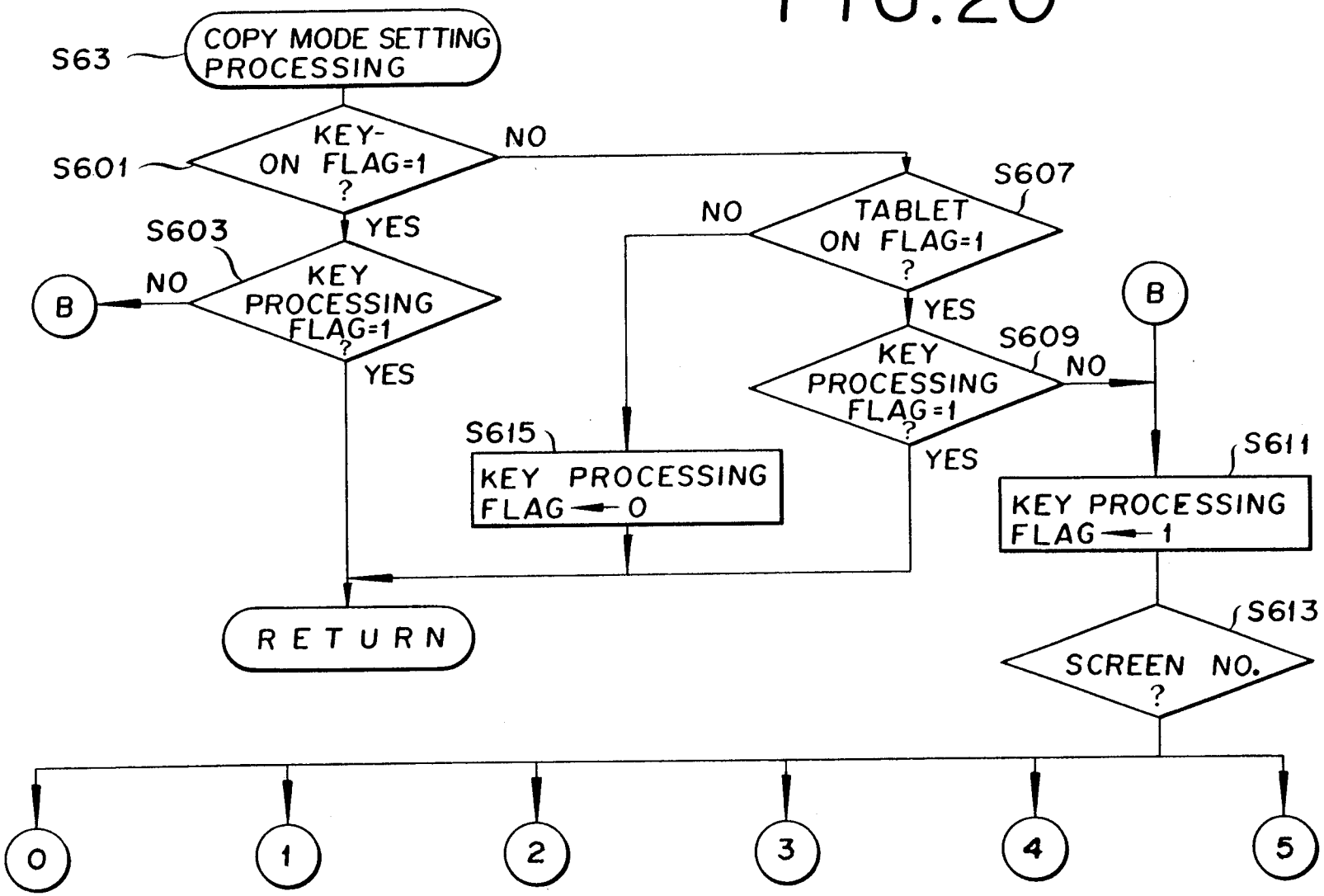
FIGS. 20 to 24, 25A, 25B and 26 are each a flow chart illustrating the sub-routine of the copy mode setting processing appearing in FIG. 17.

At the step S601 of FIG. 20, the decision is made as to whether the key on flag has been set or reset by the subroutine of the key input processing shown in FIG. 18. When the fact that the key on flag has been set is discerned at this step and further the fact that the key processing flag has not been set is discerned at the step S603, the processing of the step S611 is carried out and the key processing flag is set. Even when the fact that the key on flag has not been set is discerned at the step S601, the key processing flag is set similarly at the step S611 so long as the fact that the tablet on flag has been set is discerned at the step S607 and the fact that the key processing flag has not been set is discerned at the step S609. At the step S613, the processing to be executed is selected in accordance with the screen number displayed on the liquid crystal display part 570 shown in FIG. 9. The key processing flag is reset at the step S615 when the key on flag and the tablet on flag have been both reset.

Figure 21:
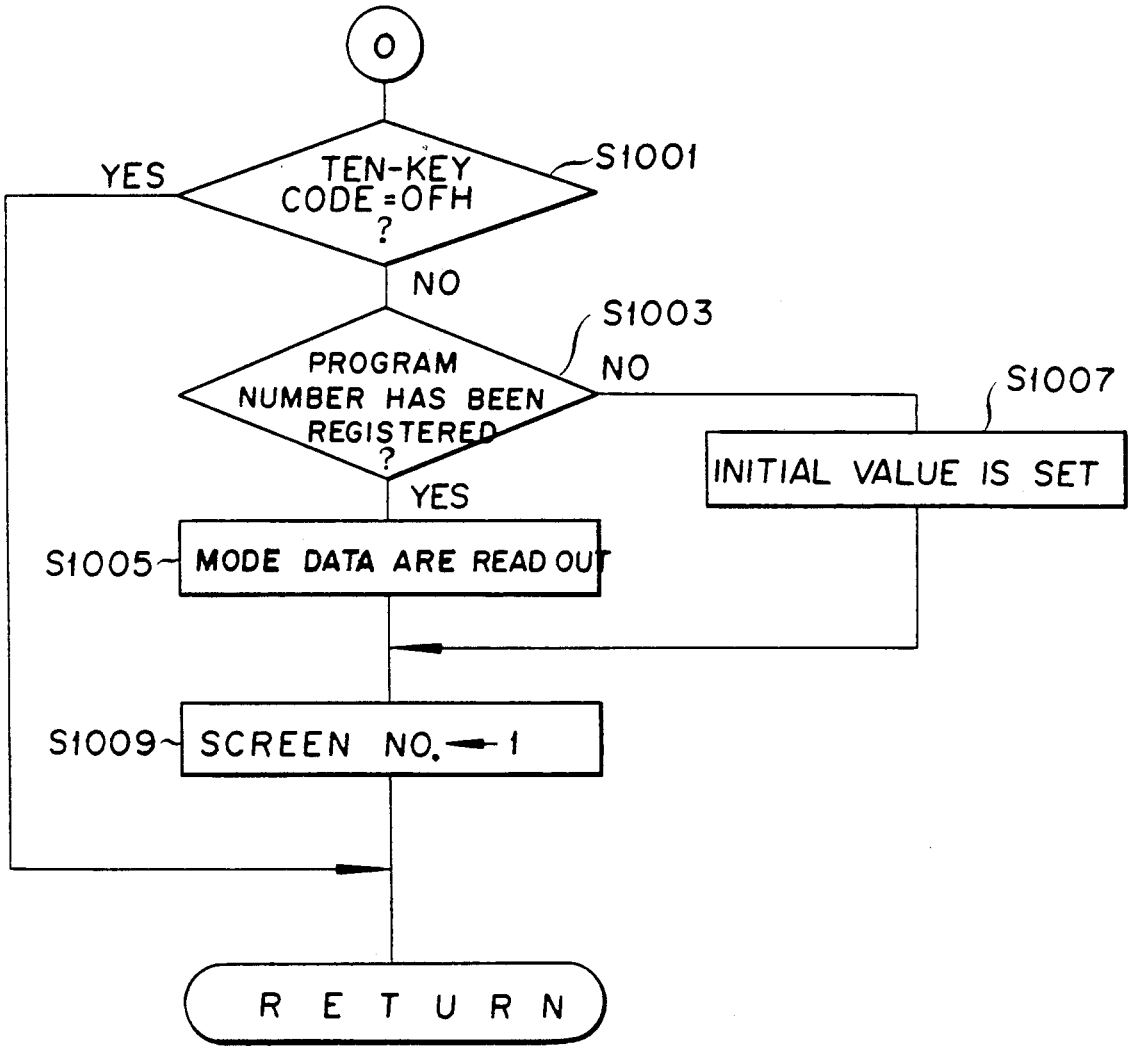

FIG. 21 illustrates the processing which is carried out when the screen number "0" is selected at the step S613. When this screen number 0 is selected, the program number is selected by the input of the data from the coordinates value from any of the ten-key marks 511 to 520 of the tablet 51G. When the code corresponding to any numeral selected from among 0 to 9 is set in the ten-key code at the step S515 (FIG. 19), NO is drawn as an answer by the decision at the step S1001 and the decision as to whether or not the program number corresponding to the numeral has been already registered is made at the step S1003. When the mode has been already registered in the program number, the mode data are read out at the step S1005. Conversely, when the mode has not yet been registered, the initial value is set in the program number at the step S1007. Then, "1" is set as the screen number.

Figure 22:
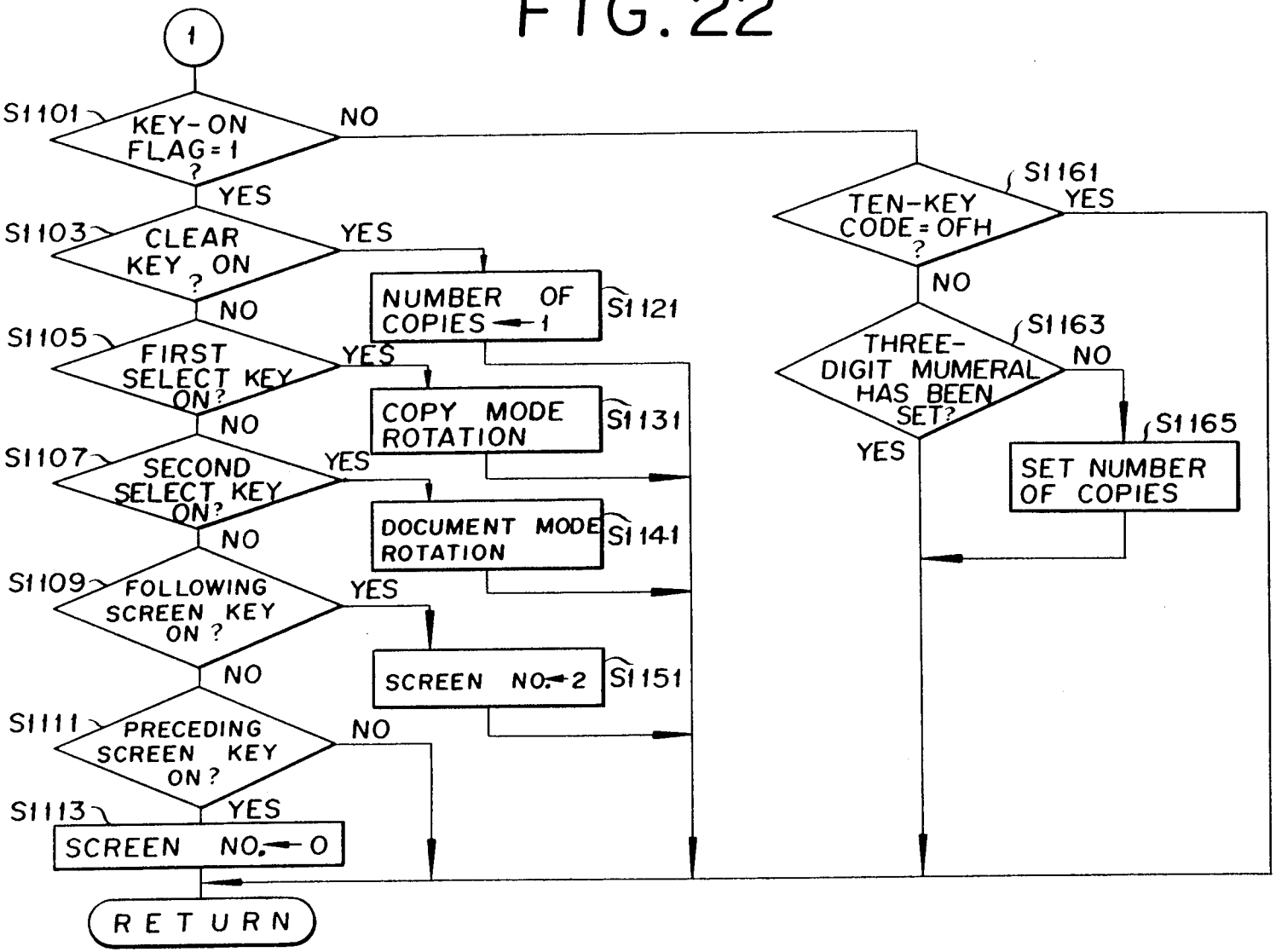

FIG. 22 is a flow chart illustrating the processing which is carried out when the screen number 1 is set.

By this screen number 1, either the number of copies to be produced is set in response to the input of the coordinates value of any of the ten-key marks 511 to 520 on the tablet 510 of the edit input device or the switching between the copy mode and the original document mode is made in response to the input from any of the key switches on the operating panel 508 of the edit input device.

The key on flag is not set when the key marks on the tablet 510 have been manipulated. As a result, NO is drawn as an answer by the decision at the step S1101 and the decision is made at the step S1161 as to whether or not any of the ten-key marks 511 to 520 on the tablet 510 has been depressed. When NO is drawn as an answer by the decision, namely the fact that one of the ten-key marks has been depressed is discerned, at the step S1161, the numeral introduced as an input at the step S1165 is set as the number of copies to be produced. When the fact that a three-digit numeral has been set is discerned at the step S1163, however, the input is ignored.

When any of the keys on the operating panel 508 of the edit input device 500 has been manipulated, the key on flag is set at "1" at the step S407 shown in FIG. 18. Consequently, YES is drawn as an answer by the decision at the step S1101 and the processing corresponding to the manipulated key switch is executed as described hereinbelow.

When the fact that the clear key 556 has been manipulated is discerned at the step S1103, the set value of the number of copies is initialized at the step S1121. When the fact that the first select key 551 has been depressed is discerned at the step S1105, the copy mode is rotatively selected from the series of the one-face copy mode, the double-faced copy mode, and the composite copy mode in the order mentioned at the step S1131 each time the key 551 is depressed once. When the fact that the second select key 551 has been depressed is discerned at the step S1107, the original document mode is rotatively selected from the series of the one face original document mode, the double-faced original document mode, and the book original document mode in the order mentioned at the step S1141 each time the key 552 is depressed once. When the fact that the following screen key 553 has been depressed is discerned at the step S1109, the screen number is set at "2" at the step S1151. When the fact that the preceding screen key 554 has been depressed is discerned at the step S1111, "0" is set as an screen number at the step S1113.

Figure 23:
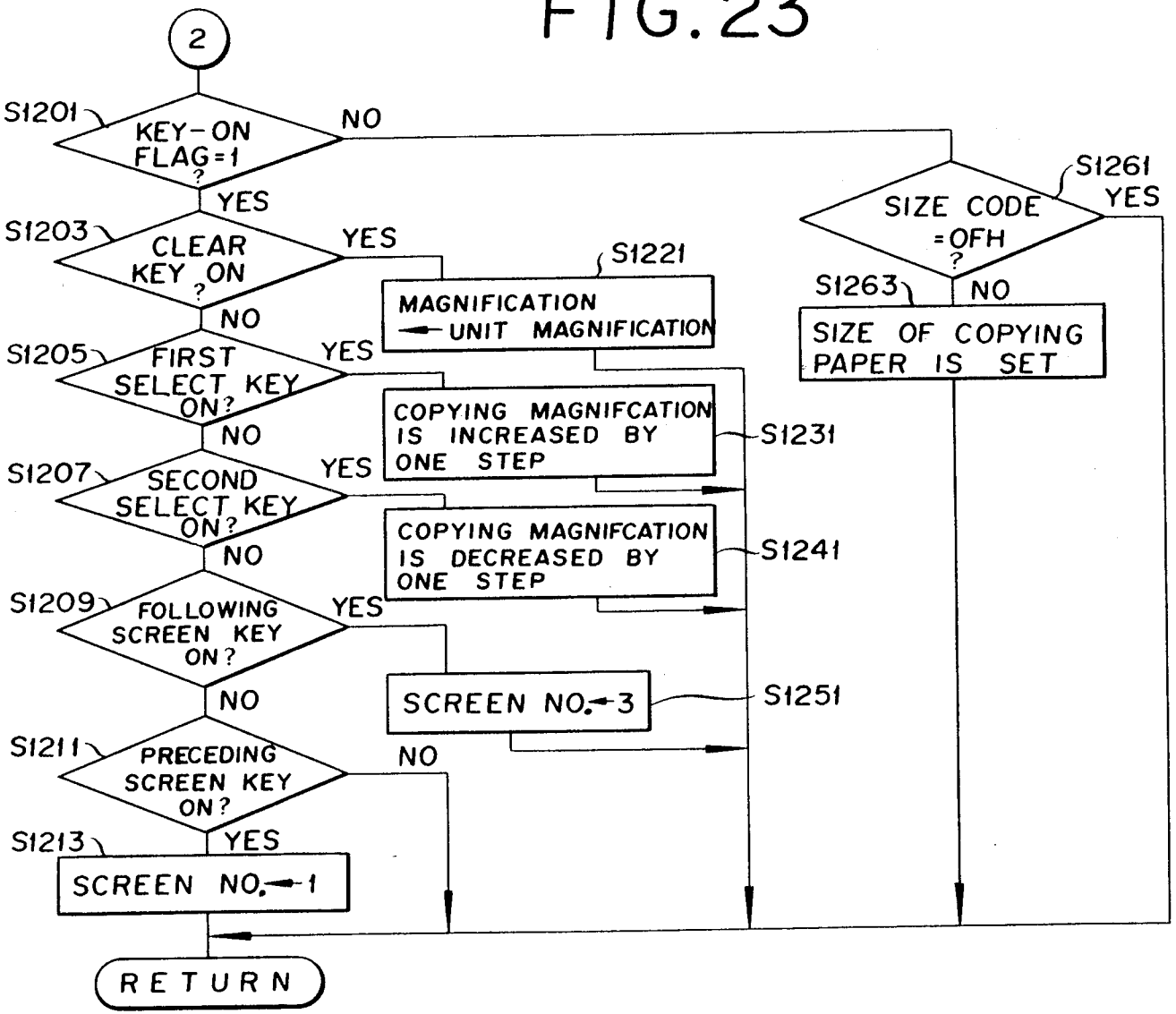

FIG. 23 is a flow chart illustrating the processing to be carried out when the screen number 37 2" is selected. By this screen number, either the size of copying paper corresponding to the manipulated key is set when any of the size selection key marks 521 to 525 on the tablet 510 is depressed or the switching of the numerical value of the ratio of magnification of copying corresponding to the size of the original document is effected in response to the manipulation of the key switches on operating panel of the edit input device.

Similarly to the step S1101 mentioned above, NO is drawn as an answer by the decision at the step S1201 when any of the key marks on the tablet 510 has been manipulated and NO is drawn as an answer by the decision at the step S1261 when any of the size selection key marks among other key marks on the tablet 510 has been manipulated. Consequently, the size of copying paper corresponding to the set size code is set at the step S1263.

Conversely, when any of the key switches on the operating panel 508 has been depressed, YES is drawn as an answer by the decision at the step S1201 and the processing corresponding to the depressed key is carried out as follows. When the fact that the clear key switch 556 has been depressed is discerned at the step S1203, the set value of the ratio of magnification is initialized to "unit magnification" at the step S1221. When the fact that the first select key 551 has been manipulated is discerned at the step S1205, the ratio of copying magnification is shifted by one step toward the increasing side at the step S1231. When the fact that the second select key 551 has been manipulated is discerned at the step S1207, the ratio of copying magnification is shifted by one step toward the decreasing side at the step S1241. When the fact that the following screen key 553 has been manipulated is discerned at the step S1209, the screen number is set at "3" at the step S1251. The screen number is set at "1" at the step S1213 when the fact that the screen key 554 has been manipulated is discerned at the step S1211.

Figure 24:
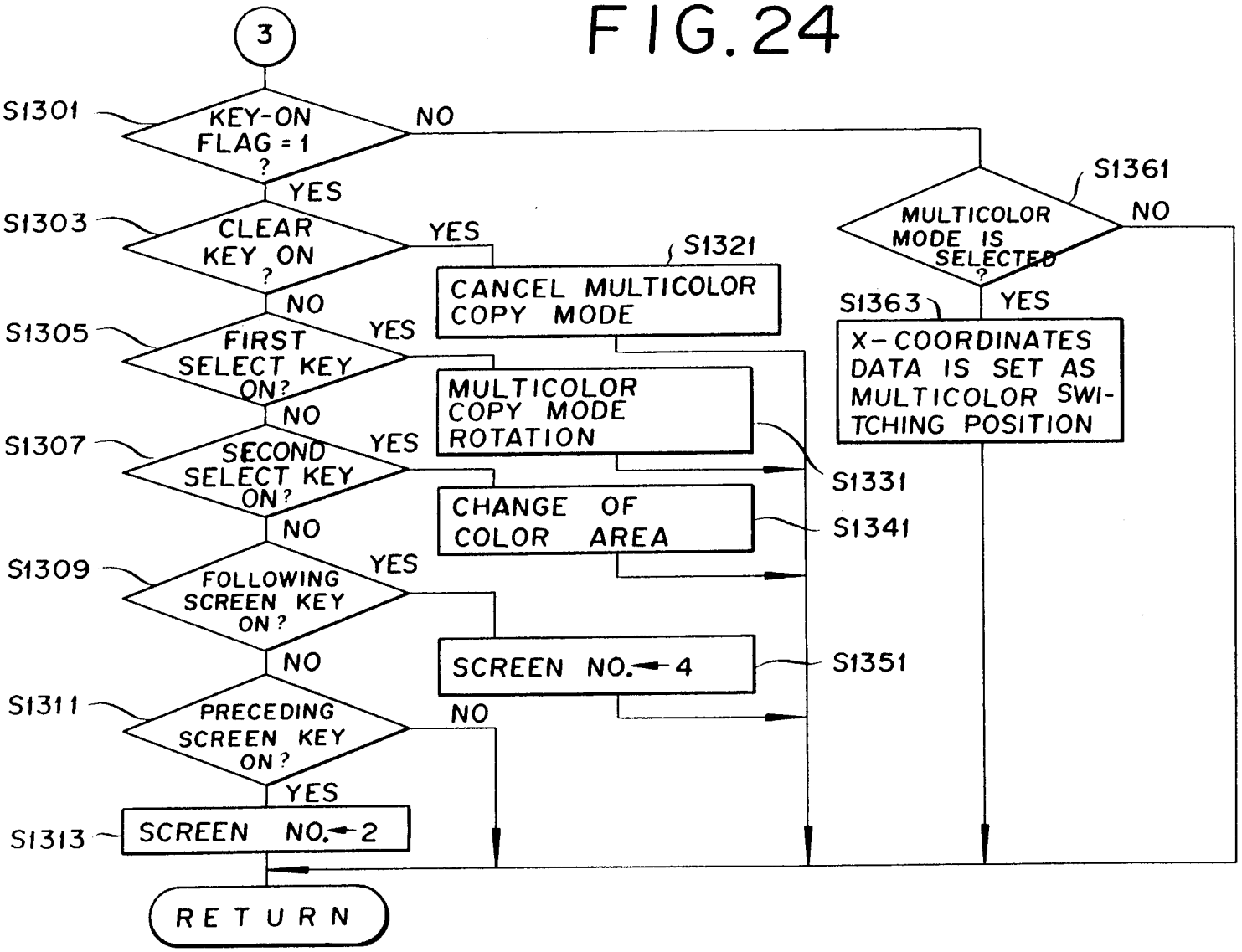

FIG. 24 is a flow chart illustrating the processing to be carried out when the screen number "3" is selected. By this screen number, either the coordinates values of the position for color switching in the multicolor copy mode is set in response to the input of the coordinates from the tablet 510 or the switching of the multicolor copy mode is carried out in response to the manipulation of the key switch on the operating panel 508.

When any of the key marks on the tablet 510 has been depressed, NO is drawn as an answer by the decision at the step S1301. Further, when the fact that the multicolor mode has been selected is discerned at the step S1361, the X-coordinate data of the introduced coordinates data are set as the coordinates data for the position of multicolor switching at the step S1363. When any of the keys installed on the operating panel 508 has been manipulated, YES is drawn as an answer by the decision at the step S1301 and the following processing is carried out in response to the manipulated key.

When the fact that the clear key 556 has been manipulated is discerned at the step S1303, the multicolor copy mode is cancelled at the step S1321. When the fact that the first selection key 551 has been manipulated is discerned at the step S1305, the copy mode is alternately selected between the two-division mode and the three-division mode at the step S1331 each time the key 551 is depressed once. When the fact that the second selection key 552 has been depressed is discerned at the step S1307, the area in which the image is formed in a color other than black is alternately between the former half area and the latter half area at the step S1341 each time the key 552 is depressed once in the two-division mode. Further at this step, the area in which the image is formed in a color other than black is selected alternately between the leading and trailing areas and the intermediate area each time the second selection key 552 is depressed once in the three-division mode. As a result, any of the modes, A to D, of the aforementioned multicolor mode is selected by jointly manipulating the two selection keys 551 and 552.

When the fact that the following screen key 553 has been depressed is discerned at the step S1309, the screen number is set at "4" at the step S1351. When the fact that the preceding screen key 554 has been depressed is discerned at the step S1311, the screen number is set at "2" at the step S1313.

Figure 25A:
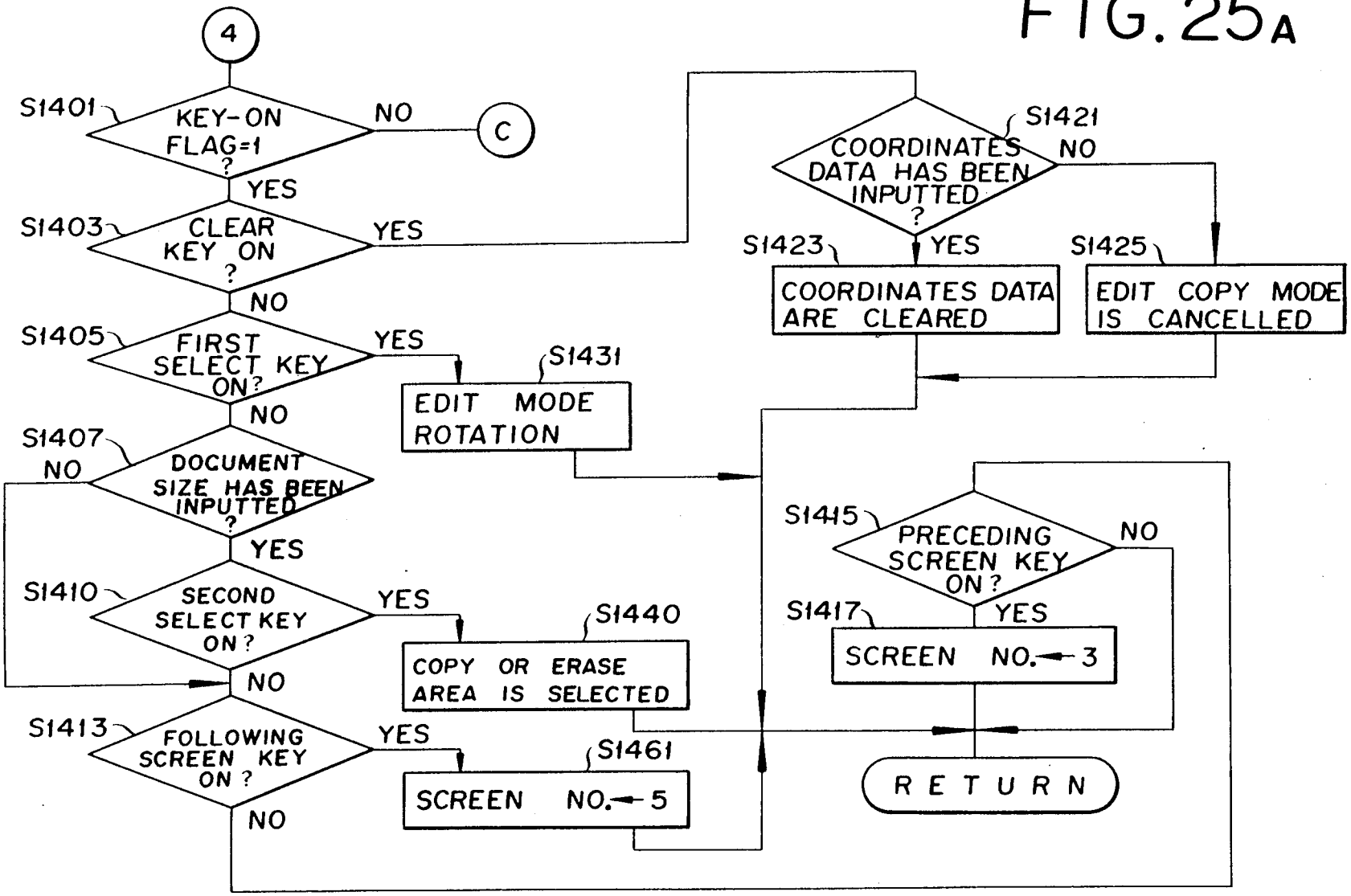
Figure 25B:
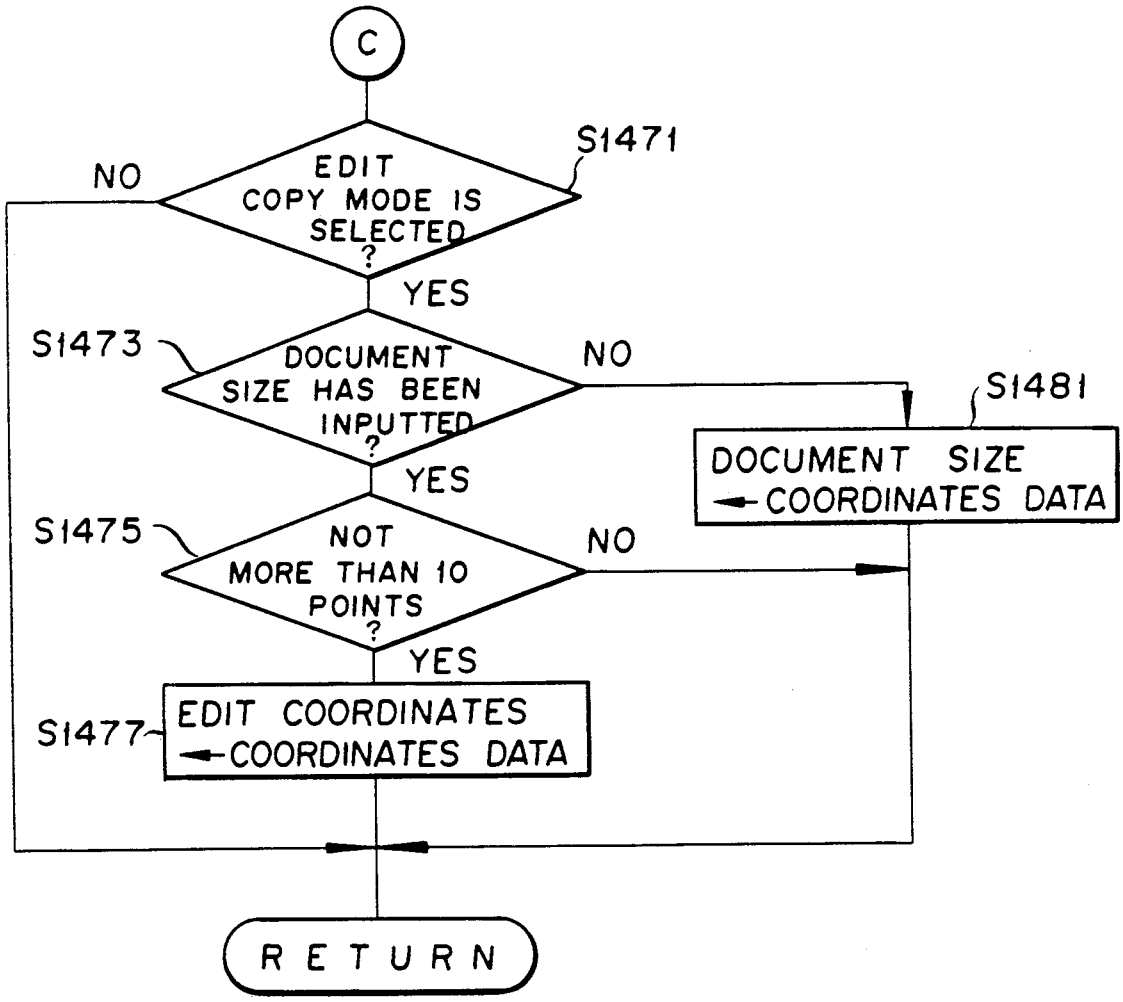

FIG. 25A and FIG. 25B are flow charts each illustrating the processing to be carried out when the screen number "4" is selected. By this screen number "4," either the edit coordinates, namely the coordinates for determining the area for edit copying, is set in response to the input of coordinates from the tablet 510 or the switching of edit copy modes is carried out in response to the key input through the operating panel 508 of the edit input device.

When any of the key marks of the tablet 500 has been manipulated, NO is drawn as an answer by the decision at the step S1401. Further, when the fact that the edit copy mode has been set is discerned at the step S1471 shown in FIG. 25B, the decision is made at the step S1473 as to whether or not the input of the original document size has been effected. When this decision draws a negative answer, the coordinates data introduced as an input by the selective depression of the key marks on the tablet 500 are set as data of the original document size at the step S1481. When the fact that the original document size has been already introduced as an input is discerned at the step S1473, the introduced coordinates data are set as data of edit coordinates at the step S1477 on the condition that the edit coordinates point already introduced are not more than 10 (YES drawn as an answer by the decision at the step S1475).

When the key switches on the operating panel 508 have been selectively manipulated, YES is drawn as an answer by the decision at the aforementioned step S1401 of FIG. 25A and the processing is carried out in response to the depressed key switch as follows. When the fact that the clear key 556 has been depressed is discerned at the step S1403, the decision is made at the step S1421 as to whether or not the introduction of coordinates data has been already effected. When the decision draws an affirmative answer, the introduced coordinates data are erased at the step S1423. When the decision draws a negative answer, the edit copy mode is cancelled at the step S1425. When the fact that the first selection key 551 has been manipulated is discerned at the step S1405, the edit mode is selected alternately between the composite copy and the color-division copy each time the key 551 is depressed once. When the fact that the second selection key 552 has been depressed is discerned at the step S1410, the processing of the step S1440 is executed on the condition that the fact that the original document size has been already introduced as an input at the step S1407. At this step, the designated area mode is selected alternately between the designated area erase and the designated area copy each time the second selection key 552 is depressed once. When the fact that the following screen key 553 has been depressed is discerned at the step S1413, "5" is set as the screen-number at the step S1461. In contrast, when the preceding screen key 554 has been depressed is discerned at the step S1415, "3" is set as the screen number at the step S1417.

Figure 26:
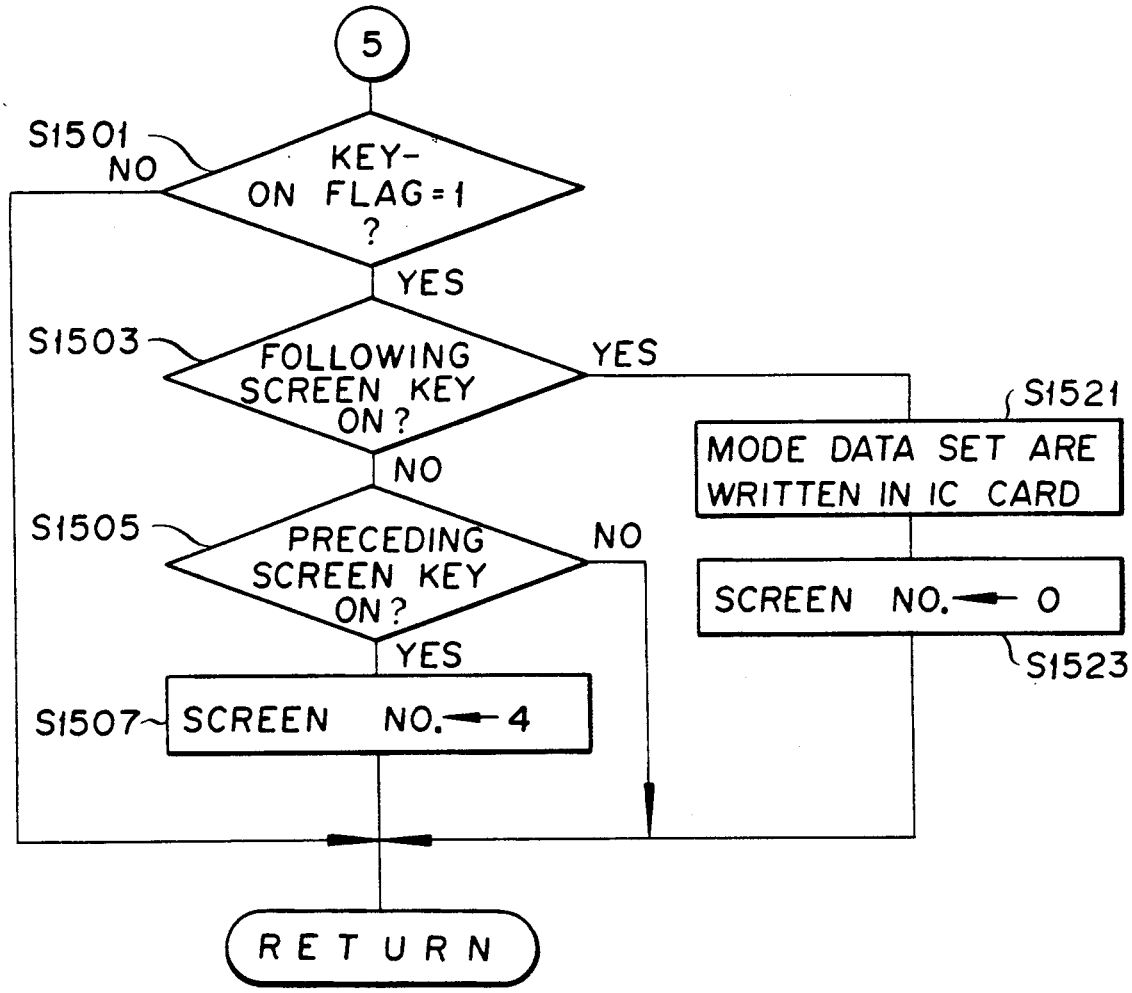

FIG. 26 is a flow chart illustrating the processing to be carried out when the screen number "5" has been selected. This screen number "5" represents the screen existing on completion of the setting. Thus, the processing to be executed when the following screen key 553 and the preceding image screen 554 have been manipulated on the operating panel 508 is carried out. When the fact that the following screen key 553 has been manipulated is discerned at the step 1501, the mode data set so far are written in the IC card at the step S1521 and "0" is set as the screen number at the step S1523. When the fact that the preceding screen key 554 has been manipulated is discerned at the step S1505, "4" is set as the screen number at the step S1507. When any of the key marks on the tablet 500 is introduced as an input, this fact is ignored at the step S1501.

Figure 27:
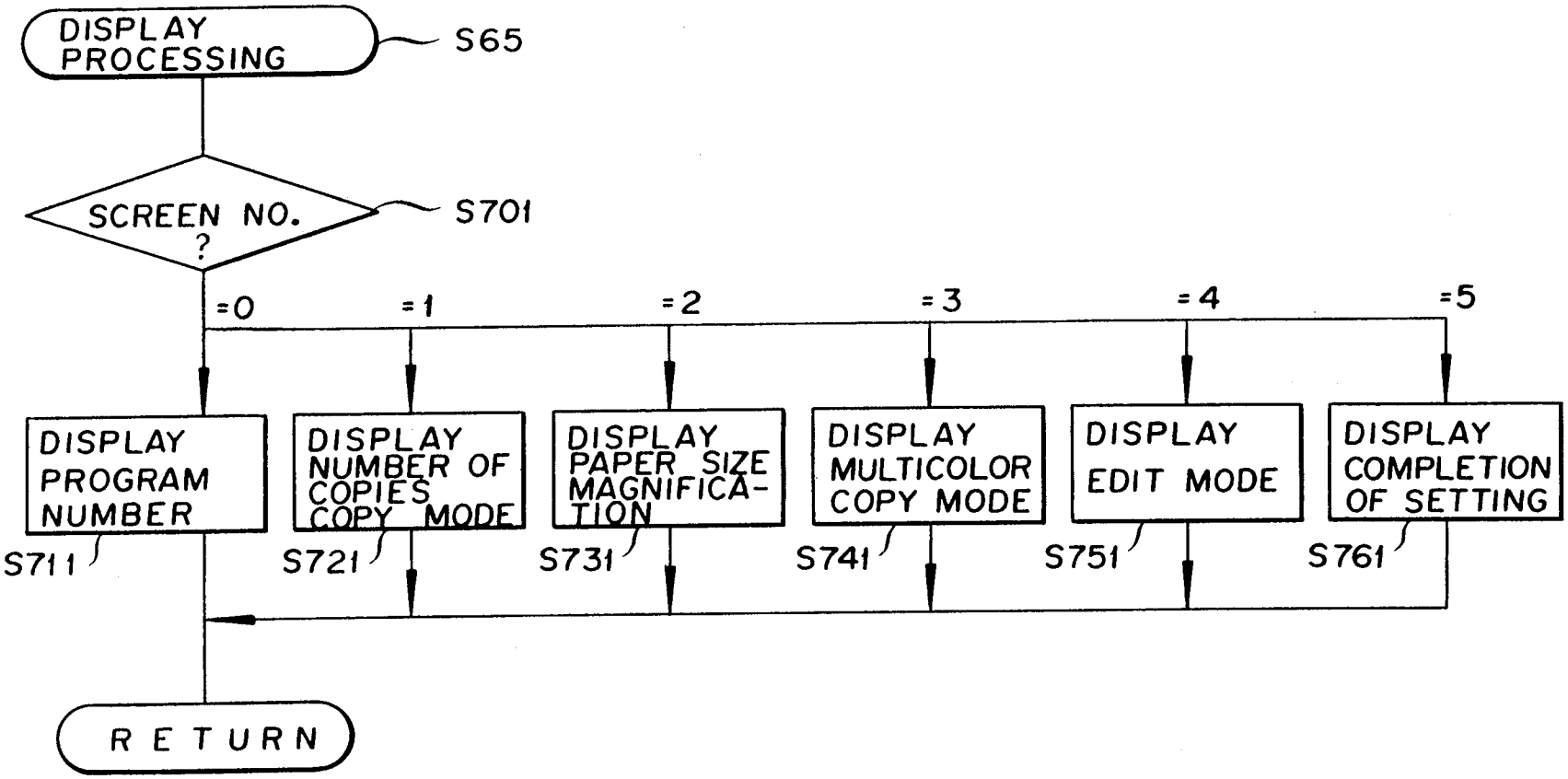
FIG. 27 is a flow chart illustrating the sub-routine of the display processing appearing in FIG. 17.

FIG. 27 is a flow chart illustrating the display processing for controlling the operation of the liquid crystal display part 570. The numerical value set as the screen number is identified at the step S701 and the processing is carried out as follows in response to this numerical value.

The step S711 represents the case in which the screen number is "0." As described with respect to FIG. 21, the program number is selected by the selective manipulation of the ten-key marks 511 to 520. At the step S721, the number of copies, the copy mode, and the original document mode are displayed when the screen number "1" is selected. In the state in which this screen is displayed, the designation of the number of copies with the ten-key marks of the tablet 510 and the selection of the copy mode and the original document mode with the key switches on the operating panel 508 are made possible as explained with respect to FIG. 22. These numerals and modes are displayed on the liquid crystal display part 570.

When the screen number "2" is selected, the copy paper size and the ratio of copying magnification are displayed on the liquid crystal display part 570 at the step S731. In this state, the designation of the copying paper size from the tablet 510 and the selection of the ratio of copying magnification from the operating panel 508 are carried out as explained with respect to FIG. 23.

When the screen number "3" is selected, the multicolor copy mode is displayed on the liquid crystal display part 570 at the step S742. In this state, the designation of coordinates for switching colors in the multicolor copy from the tablet 510 and the selection of the multicolor mode from the operating panel 508 are effected as explained with respect to FIG. 24.

When the screen number "4" is selected, the edit mode is displayed at the step S751. In this state, the designation of the coordinates edit from the table 510 and the selection of the edit mode from the operating panel 508 are made possible as explained with respect to FIG. 25.

When the screen number "5" is selected, the screen indicating completion of setting is displayed at the step S761. In this state, the input from the tablet is ignored and the switching of screens from the operating panel 508 and the writing of the selected mode in the IC card 600 are made possible as explained with respect to FIG. 26.

I claim:

1. An original document image edit input device for supplying data on a copying mode and an editing mode to a copying machine which can reproduce an image of an original document on a copying paper, which device comprises:

a tablet provided with a surface conforming to an original document to be copied;

coordinate data forming means adapted to produce, in response to a depression on the surface of said tablet in an ordinary input mode, coordinated data corresponding to the coordinates of the position of said depression;

switching means for switching the input mode from said ordinary input mode to a numerical value input mode, and numerical data forming means for forming, in response to a depression exerted at a desired position on the surface of said tablet in the situation in which said numerical value input mode has been set by said switching means, numerical data corresponding to the position of said depression, said numerical data differing from said coordinate data and said surface of said tablet having numerical information thereon.

2. A device according to claim 1, wherein said numerical data to be formed are set as numbers of copies to be produced.

3. A device according to claim 1, wherein said numerical data to be formed are set as ratios of copying magnification.

4. A device according to claim 1, wherein the data introduced as an input by the manipulation of said tablet are transmitted to said copying machine by a memory medium.

5. An original document image edit input device for supplying data on a copying mode and an editing mode to a copying machine serving to reproduce an image of an original document on a copying paper, which device comprises:

a tablet provided with a surface conforming to an original document to be copied;

coordinate data forming means adapted to produce, in response to a depression of the surface of said tablet in an ordinary input mode, coordinate data corresponding to the coordinates of the position of said depression;

switching means for switching said ordinary input mode to a copying paper size input mode, and size data forming means for forming, in response to a depression exerted at a desired portion on the surface of said tablet in the situation in which said copy mode has been set by said switching means, copying paper size data corresponding to the position of said depression and differing from said coordinate data, wherein size marks destined to form corresponding copying paper size data are printed on the surface of said tablet.

6. A device according to claim 5, wherein the positions of said size marks correspond to the actual sizes of copying papers.

7. A device according to claim 5, wherein the data introduced as an input by the manipulation of said tablet are transmitted to said copying machine by a memory medium.

8. An original document image edit input device for feeding operating modes and data on copying and editing to a copying machine serving to reproduce an image of an original document on a copying paper, which device comprises:

a tablet provided with a surface conforming to an original document to be copied;

coordinate data forming means adapted to produce, in response to a depression on the surface of said tablet in the ordinary input mode, coordinate data corresponding to the coordinates of the position of said depression;

switching means for switching said ordinary input mode to a copying paper size input mode, and size data forming means for forming, in response to a depression exerted at one of specified portions on the surface of said tablet in the situation in which said copy mode has been set by said switching means, copying paper size data corresponding to a size which is denoted by the specified portion as an actual copying paper size and differing from said coordinate data.

* * * * *